US012728321B2

(12) United States Patent
Milleman et al.

(10) Patent No.: US 12,728,321 B2
(45) Date of Patent: Sep. 8, 2026

(54) GOLF CLUB HEAD WITH LIGHTWEIGHT SHAFT-RECEIVING STRUCTURE

(71) Applicant: KARSTEN MANUFACTURING CORPORATION, Phoenix, AZ (US)

(72) Inventors: Travis D. Milleman, Cave Creek, AZ (US); Joshua B. Matthews, Chino Hills, CA (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 778 days.

(21) Appl. No.: 18/159,805

(22) Filed: Jan. 26, 2023

(65) Prior Publication Data

US 2023/0233907 A1 Jul. 27, 2023

Related U.S. Application Data

(60) Provisional application No. 63/267,183, filed on Jan. 26, 2022.

(51) Int. Cl.

| | |
|---|---|
| ***A63B 53/02*** | (2015.01) |
| ***A63B 53/04*** | (2015.01) |
| ***A63B 102/32*** | (2015.01) |

(52) U.S. Cl.

CPC ..... *A63B 53/022* (2020.08); *A63B 53/0466* (2013.01); *A63B 2102/32* (2015.10)

(58) Field of Classification Search

CPC ..... A63B 53/023; A63B 53/02; A63B 53/022; A63B 53/22; A63B 53/025; A63B 53/026; A63B 53/027

See application file for complete search history.

(56) References Cited

U.S. PATENT DOCUMENTS

| | | | |
|---|---|---|---|
| 1,894,706 | A | 1/1933 | Reach |
| 4,607,846 | A | 8/1986 | Perkins |
| 4,836,545 | A | 6/1989 | Pompa |
| 4,954,198 | A | 9/1990 | Viellard |
| 5,851,155 | A | 12/1998 | Wood |
| 6,050,903 | A | 4/2000 | Lake |
| 6,106,412 | A | 8/2000 | Kosugi |
| 6,352,482 | B1 | 3/2002 | Jacobson |
| 6,475,100 | B1 | 11/2002 | Helmstetter |
| 6,752,726 | B2 | 6/2004 | Burrows |
| 7,115,046 | B1 | 10/2006 | Evans |
| 7,241,229 | B2 | 7/2007 | Poynor |
| 7,344,449 | B2 | 3/2008 | Hocknell |

(Continued)

FOREIGN PATENT DOCUMENTS

| | | |
|---|---|---|
| CN | 2813013 | 9/2006 |
| GB | 420332 | 11/1934 |

(Continued)

*Primary Examiner* — Michael D Dennis

(57) ABSTRACT

A golf club head with a lightweight shaft-receiving structure is described herein. The lightweight shaft-receiving structure comprises one or more lightweight components provided in low-stress areas of the club head, wherein the lightweight components form portions of the shaft-receiving structure that would otherwise be formed by higher-density body material. The lightweight shaft-receiving structure creates discretionary mass that can be redistributed to improve the club head mass properties.

6 Claims, 17 Drawing Sheets

(56) References Cited

U.S. PATENT DOCUMENTS

| | | | |
|---|---|---|---|
| 7,566,279 | B2 | 7/2009 | Nakashima |
| 7,819,754 | B2 | 10/2010 | Evans |
| 7,819,755 | B2 | 10/2010 | Sugimae |
| 7,892,105 | B2 | 2/2011 | Galloway |
| 7,922,600 | B1 | 4/2011 | Ambrose |
| 7,938,735 | B2 | 5/2011 | Lau |
| 8,088,019 | B1 | 1/2012 | Long |
| 8,382,607 | B2 | 2/2013 | Burnett |
| 8,523,702 | B2 | 9/2013 | Thomas |
| 8,562,453 | B2 | 10/2013 | Sato |
| 8,574,092 | B2 | 11/2013 | Galloway |
| 8,574,093 | B2 | 11/2013 | Sato |
| 8,696,488 | B2 | 4/2014 | Burnett |
| 8,753,221 | B1 | 6/2014 | Aguinaldo |
| 8,858,357 | B2 | 10/2014 | Golden |
| 9,114,291 | B2 | 8/2015 | Bolane |
| 9,168,426 | B2 | 10/2015 | Solheim |
| 9,327,170 | B2 | 5/2016 | Solheim |
| 9,610,479 | B2 | 4/2017 | Barelmann |
| 9,616,298 | B1 | 4/2017 | Barksdale |
| 9,630,070 | B2 | 4/2017 | Parsons |
| 9,861,871 | B2 | 1/2018 | Solhaug |
| 10,155,145 | B2 | 12/2018 | Girard |
| 2003/0069080 | A1 | 4/2003 | McCabe |
| 2005/0282653 | A1 | 12/2005 | Murphy |
| 2007/0078026 | A1* | 4/2007 | Holt ..... A63B 60/00 473/307 |
| 2007/0270237 | A1 | 11/2007 | Tavares |
| 2008/0254908 | A1 | 10/2008 | Bennett |
| 2008/0280693 | A1 | 11/2008 | Chai |
| 2009/0042665 | A1 | 2/2009 | Morales |
| 2010/0255927 | A1 | 10/2010 | Evans |
| 2014/0370999 | A1* | 12/2014 | Solheim ..... A63B 53/0466 473/305 |
| 2016/0059093 | A1* | 3/2016 | Nielson ..... A63B 53/02 473/338 |
| 2016/0346630 | A1 | 12/2016 | Sander |

FOREIGN PATENT DOCUMENTS

| | | |
|---|---|---|
| GB | 2225725 | 6/1990 |
| JP | H053934 | 1/1993 |
| JP | H10151228 | 6/1998 |
| JP | 3294568 | 6/2002 |
| JP | 2005253575 | 9/2005 |
| KR | 101135883 | 4/2012 |
| WO | 2000062873 | 10/2000 |

* cited by examiner

GOLF CLUB HEAD WITH LIGHTWEIGHT SHAFT-RECEIVING STRUCTURE

CROSS REFERENCE PRIORITIES

This claims the benefit of U.S. Provisional Application No. 63/267,183, filed Jan. 26, 2022, the contents of which are fully incorporated herein by reference.

TECHNICAL FIELD

This disclosure relates generally to golf clubs and, more particularly, to golf club heads with lightweight adjustable shaft-receiving structures.

BACKGROUND

In order to achieve maximum performance in the sport of golf, golf club heads must be customizable to particular players. One example of customizability in golf club head design is providing a golf club head with a loft angle and/or lie angle tailored to the player. Loft and lie angle adjustability is often achieved through the use of an adjustable shaft-receiving mechanism. However, such mechanisms require additional components comprising a significant amount of mass (in comparison to non-adjustable shaft-receiving mechanisms). Inclusion of the adjustable components reduces the amount of discretionary mass that can be reallocated in strategic areas of the club head to optimize club head mass properties (i.e center of gravity position and moment of inertia) and improve the performance of the club head.

Prior art club heads, illustrated in FIGS. 1 and 2, comprise adjustable shaft-receiving structures 150 including a shaft sleeve 166 and a hosel 152 configured to receive the shaft sleeve 166 that contribute a significant amount of mass to the club head 100. A typical prior art shaft-receiving structure 150 comprises a hosel 152 and a shaft sleeve 166 insertable into the hosel 152. The shaft sleeve 166 is configured to couple a golf club shaft (not shown) to the club head 100 and provide adjustability of the loft angle and/or lie angle of the club head 100 at address. The hosel 152 can comprise a hosel bore 156 configured to receive the shaft sleeve 166, the hosel bore 156 defining a hosel bore axis 168 concentric to the hosel bore 156. The hosel 152 can define a hosel bore opening 158 at the upper end of the hosel wall 154. The shaft sleeve 166 and the hosel 152 can comprise corresponding receiving geometries to allow the shaft sleeve 166 to be removably and adjustably coupled within the hosel bore 156. In many cases, the loft and/or lie angle of the club head can be adjusted by adjusting the position of the shaft sleeve 166 within the hosel bore 156. The shaft sleeve 166 can be secured to the hosel 150 by a fastener 176. The fastener 176 can extend through a lower opening 174 formed in the shaft-receiving structure 150 and couple to a bottom end of the shaft sleeve 166. The fastener 176 can releasably couple the shaft sleeve 166 to the hosel 152.

Many prior-art shaft receiving structures 150 comprise a plurality of internal components that are formed by the club head body 101. As illustrated in FIG. 1, many prior-art shaft-receiving structures 150 comprise a hosel tube 160 extending from the hosel bore opening 158 to the hosel base 162, the hosel tube 160 holding the shaft sleeve 166 in place and sealing the hosel bore 156 from the interior cavity 107. In the prior art, the entire hosel 152, the hosel tube 160, and the hosel base 162 are all typically formed integrally with the club head body 101 and therefore add a significant amount of mass to the shaft-receiving structure 150. The shaft sleeve 166 can be secured to the hosel 150 by a fastener 176. The fastener 176 can extend through a lower opening 174 formed in the shaft-receiving structure 150 and couple to a bottom end of the shaft sleeve 166.

As illustrated in FIG. 1 and FIG. 2, the hosel tube 160 does not provide contact support for the shaft sleeve 166 when the shaft sleeve 166 is inserted within the hosel bore 156. Instead, the shaft sleeve 166 is primarily supported by the hosel wall 154 at the hosel bore opening 158 and through the tension with the threaded fastener 176. In turn, the head of the threaded fastener 176 is in contact with the hosel base 162 proximate the lower opening 174. Any stresses imparted to the golf club head 100 during use through the shaft are transmitted through the shaft sleeve 166 at the contact points of the hosel bore opening 158 and the hosel base 162. Because the hosel tube 160 is not in contact with the shaft sleeve 166, the hosel tube 160 bears only a small amount of the golf swing stress loading.

In the prior art shaft-receiving structures 150, the various components described above (i.e. the hosel wall 154, hosel tube 160, hosel base 162, shaft sleeve 166, fastener 176, etc.) are formed of steel or another relatively high-density metal material. As such, providing an adjustable shaft-receiving structure in a golf club head has traditionally reduced the amount of discretionary mass available for improving the club head mass properties. There is a need in the art for a shaft-receiving structure that allows loft and lie adjustability, creates discretionary mass to be redistributed throughout the club head to increase performance, and preserves the structural integrity of the club head.

BRIEF DESCRIPTION OF THE DRAWINGS

To facilitate further description of the embodiments, the following drawings are provided in which.

Figure 1:
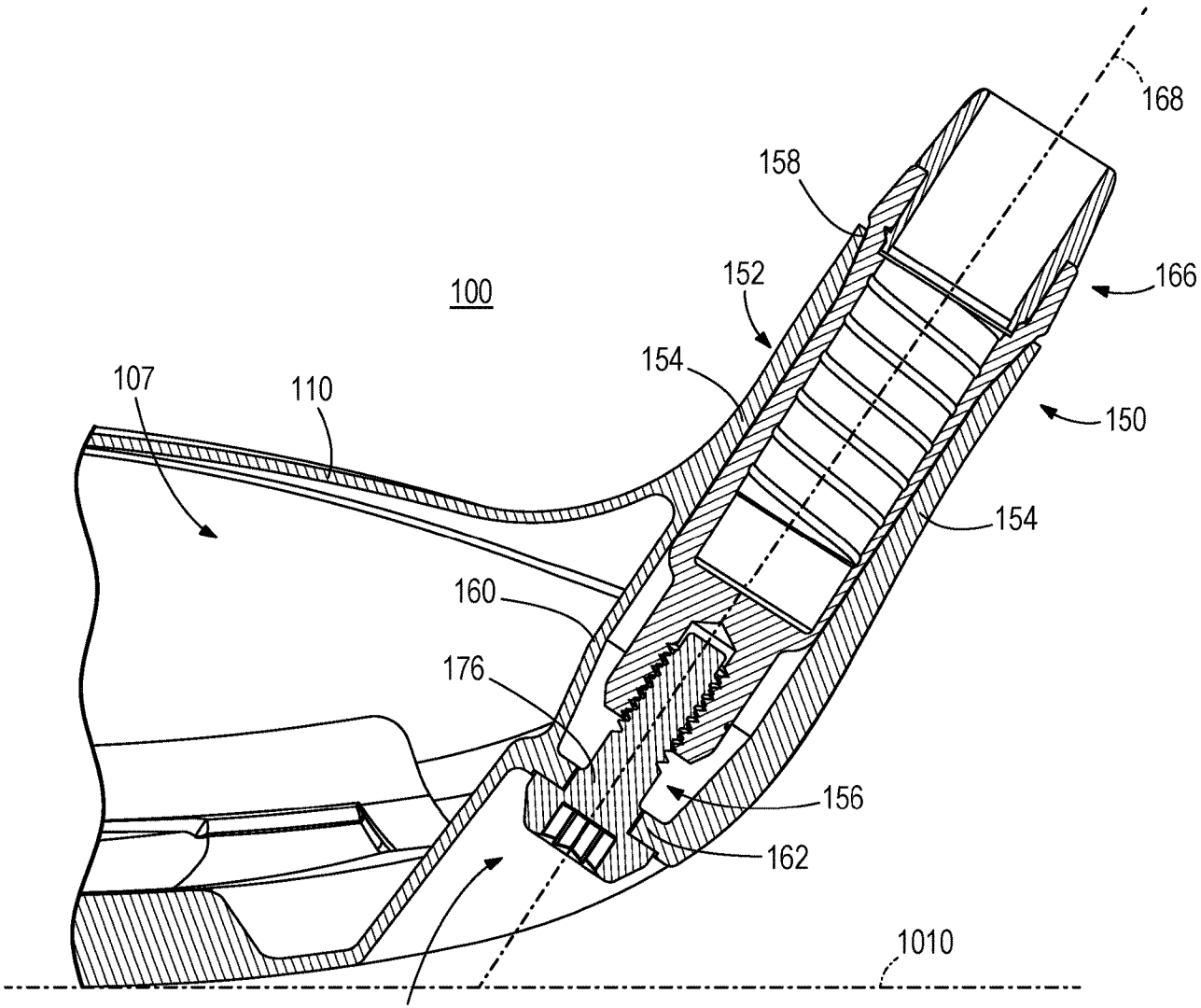
FIG. 1 PRIOR ART
FIG. 1 illustrates a front cross-sectional view of a shaft-receiving structure for a prior-art golf club head.

Described herein are various embodiments of a golf club head comprising a lightweight adjustable shaft-receiving structure. The lightweight shaft-receiving structure comprises a reduced mass that creates discretionary mass that can be applied to club head to improve mass properties such as CG position and moment of inertia. The shaft-receiving structure comprises a variety of components, some of which can be constructed of a lightweight material to reduce the overall mass of the shaft-receiving structure. A reduction in the mass of the shaft-receiving structure creates discretionary mass that can be redistributed in strategic locations to create a high-performance club head with improved mass properties.

In particular, the lightweight shaft-receiving structure provides lightweight (i.e. low-density) components in areas of the club head that do not bear significant stress load during the golf swing or at impact between the club head and a golf ball. In many embodiments, portions of the shaft receiving structure spaced away from the contact points between the hosel and the shaft sleeve and/or the contact points between the hosel base and the fastener typically experience negligible stress at impact. The shaft-receiving structure therefore does not rely on any structural components provided in said low-stress portions for the structural integrity of the club head. In many embodiments, lightweight components, such as a lightweight hosel tube insert, hosel insert, or end cap, can be provided in said areas for non-load-bearing purposes. In some embodiments, certain components typically provided in the prior art shaft-receiving structures, such as the hosel tube, can be removed entirely without sacrificing the structural integrity of the club head.

The lightweight shaft-receiving structure provides lightweight components to reduce the overall mass of the shaft-receiving structure and create discretionary mass. The lightweight shaft-receiving structure can create up to 12 more grams of discretionary mass in comparison to a similar prior art shaft-receiving structure lacking lightweight components. In many embodiments, the lightweight shaft-receiving structure comprises a lightweight hosel tube insert with a density less than 3 g/cm$^3$ that seals the hosel bore from the interior cavity without contributing a significant amount of mass. In other embodiments, the lightweight shaft-receiving structure comprises a "tube-less" wherein the hosel tube is removed entirely, providing a maximum reduction in the mass of the shaft-receiving structure. In many embodiments, the discretionary mass created by the lightweight shaft-receiving structure provides a club head with improved mass properties. In many embodiments, the discretionary mass can be used to lower the CG height and/or alter the CG depth to provide a club head with higher launch, less spin, and/or more ball speed. In some embodiments, the discretionary mass can be used to provide an increased moment of inertia over a similar club head with a prior art shaft-receiving structure.

DEFINITIONS

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "lightweight" or "low-density" as described herein, in reference to components of the shaft-receiving structure, describe components that are constructed of materials with a lesser density than the metallic material that makes up at least a portion of the club head body.

The terms "replacing" or "replace" as described herein, in reference to the lightweight components of the shaft-receiving structure, refer to the ability of the lightweight component in question to form a portion of the shaft-receiving structure which, in prior art embodiments, would otherwise be formed of the higher-density metallic club head body material. The present disclosure uses the prior art as a reference to illustrate features of the shaft-receiving structure that can be substituted or replaced by the lightweight components described herein.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "strike face," as used described, refers to a club head front surface that is configured to strike a golf ball. The term strike face can be used interchangeably with the "face."

The term "strike face perimeter," as described herein, can refer to an edge of the strike face. The strike face perimeter can be located along an outer edge of the strike face where the curvature deviates from a bulge and/or roll of the strike face.

The term "geometric centerpoint," or "geometric center" of the strike face, as described herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as described herein, can refer to a reference plane associated with the surface on which a golf ball is placed. The ground plane can be a horizontal plane tangent to the sole at an address position.

The term "loft plane," as described herein, can refer to a reference plane that is tangent to the geometric centerpoint of the strike face.

The term "loft angle," as described herein, can refer to an angle measured between the loft plane and a plane perpendicular to the ground plane.

The term "face height," as described herein, can refer to a distance measured parallel to loft plane between a top end of the strikeface perimeter and a bottom end of the strikeface perimeter.

The term "lie angle," as described herein, can refer to an angle between a hosel axis, extending through the hosel, and the ground plane. The lie angle is measured from a front view.

The "depth" of the golf club head, as described herein, can be defined as a front-to-rear dimension of the golf club head.

The "height" of the golf club head, as described herein, can be defined as a crown-to-sole dimension of the golf club head. In many embodiments, the height of the club head can be measured according to a golf governing body such as the United States Golf Association (USGA).

The "length" of the golf club head, as described herein, can be defined as a heel-to-toe dimension of the golf club head. In many embodiments, the length of the club head can be measured according to a golf governing body such as the United States Golf Association (USGA).

The "geometric center height" of the fairway-type golf club head, as described herein, is a height measured perpendicular from the ground plane to the geometric centerpoint of the golf club head.

The "leading edge" of the club head, as described herein, can be identified as the most sole-ward portion of the strike face perimeter.

An "XYZ" coordinate system of the golf club head, as described herein, is based upon the geometric center of the strike face. The golf club head dimensions as described herein can be measured based on a coordinate system as defined below. The coordinate system is described in reference to FIGS. 4 and 5. The geometric center 120 of the strike face 102 defines a coordinate system having an origin located at the geometric center 120 of the strike face 102. The coordinate system defines an X-axis 1040, a Y-axis 1050, and a Z-axis 1060. The X-axis 1040 extends through the geometric center 120 of the strike face 102 in a direction from the heel 104 to the toe 106 of the club head 100. The Y-axis 1050 extends through the geometric center 120 of the strike face 102 in a direction from the crown 110 to the sole 112 of golf club head 100. The Y-axis 1050 is perpendicular to the X-axis 1040. The Z-axis 1060 extends through the geometric center 120 of the strike face 102 in a direction from the front end 108 to the rear end 111 of the golf club head 100. The Z-axis 1060 is perpendicular to both the X-axis 1040 and the Y-axis 1050.

The term or phrase "center of gravity position" or "CG location" can refer to the location of the club head center of gravity (CG) 199 with respect to the XYZ coordinate system, wherein the CG position is characterized by locations along the X-axis 1040, the Y-axis 1050, and the Z-axis 1060. The term "CGx" can refer to the CG location along the X-axis 1050, measured from the origin point 120. The term "CG height" can refer to the CG location along the Y-axis 1050, measured from the origin point 120. The term "CGy" can be synonymous with the CG height. The term "CG depth" can refer to the CG location along the Z-axis 1060, measured from the origin point 120. The term "CGz" can be synonymous with the CG depth.

The XYZ coordinate system of the golf club head, as described herein defines an XY plane extending through the X-axis 1040 and the Y-axis 1050. The coordinate system defines XZ plane extending through the X-axis 1040 and the Z-axis 1060. The coordinate system further defines a YZ plane extending through the Y-axis 1050 and the Z-axis 1060. The XY plane, the XZ plane, and the YZ plane are all perpendicular to one another and intersect at the coordinate system origin located at the geometric center 120 of the strike face 102. In these or other embodiments, the golf club head 100 can be viewed from a front view when the strike face 102 is viewed from a direction perpendicular to the XY plane. Further, in these or other embodiments, the golf club head 100 can be viewed from a side view or side cross-sectional view when the heel 104 is viewed from a direction perpendicular to the YZ plane.

Figure 4:
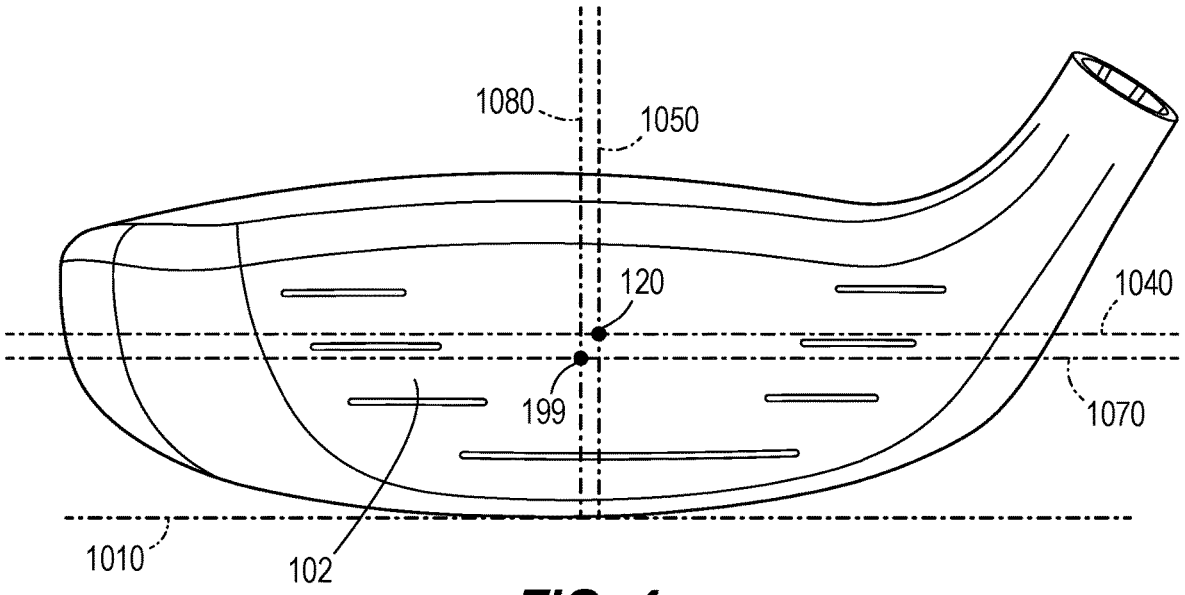
FIG. 4 illustrates a front view of the wood-type golf club head of FIG. 3.
Figure 5:
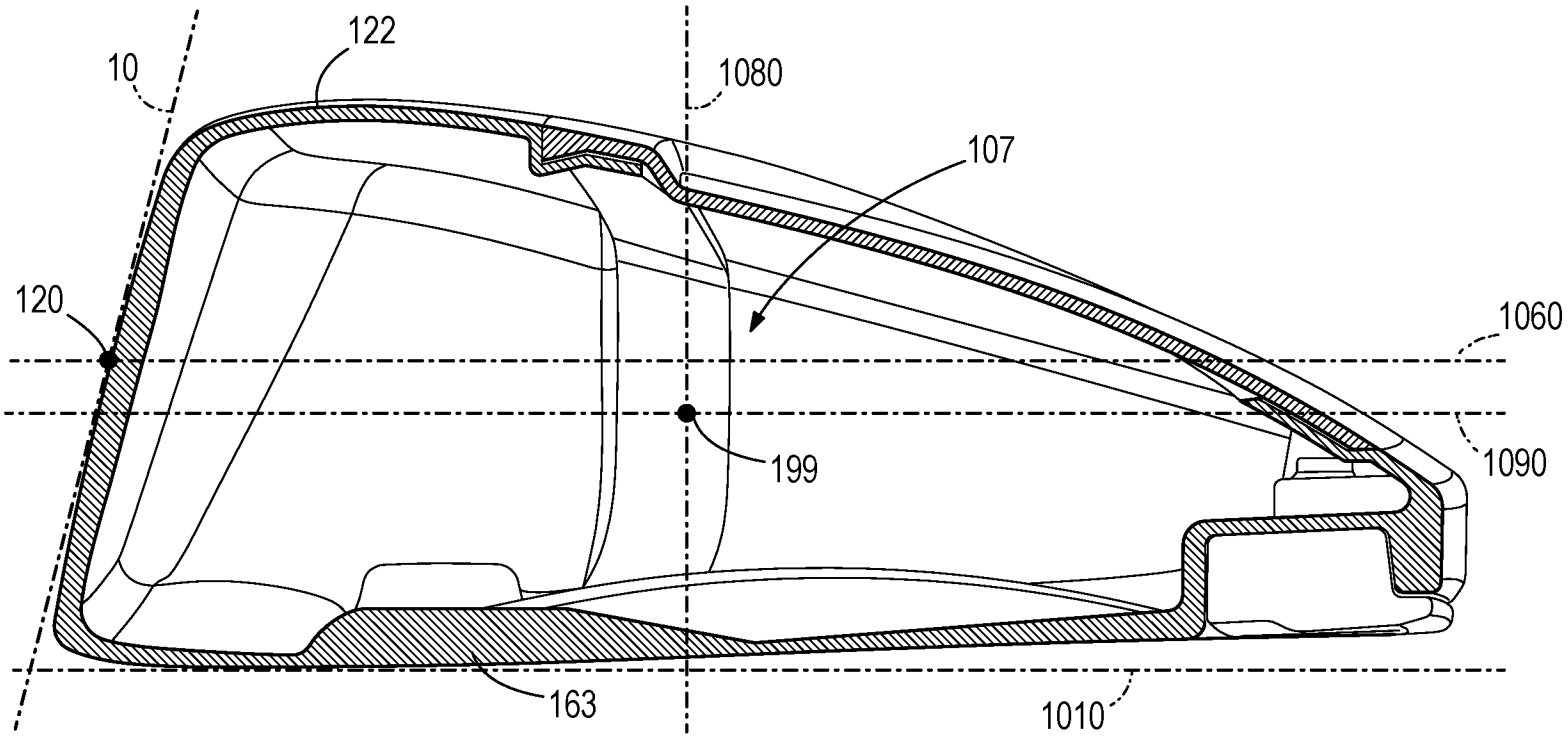
FIG. 5 illustrates a heel-side cross-sectional view of the wood-type golf club head of FIG. 3.

Illustrated in FIGS. 4 and 5, the golf club head 100 further comprises a coordinate system centered about the center of gravity 199. The coordinate system comprises an X'-axis 1070, a Y'-axis 1080, and a Z'-axis 1090. The X'-axis 1070 extends in a heel-to-toe direction. The X'-axis 1070 is positive towards the heel 104 and negative towards the toe 106. The Y'-axis 1080 extends in a sole-to-crown direction and is orthogonal to both the Z'-axis 1090 and the X'-axis 1070. The Y'-axis 1080 is positive towards the crown 110 and negative towards the sole 112. The Z'-axis 1090 extends front-to-rear, parallel to the ground plane and is orthogonal to both the X'-axis 1070 and the Y'-axis 1080. The Z'-axis 1090 is positive towards the strike face 102 and negative towards the rear 111.

The term or phrase "moment of inertia" (hereafter "MOI") as define herein can refer to values measured about the CG 199. The term "Ixx" can refer to the MOI measured in the heel-to-toe direction, about the X'-axis 1070. The term "Iyy" can refer to the MOI measured in the sole-to-crown direction, about the Y'-axis 1080. The term "Izz" can refer to the MOI measured in the front-to-back direction, about the Z'-axis 1090. The MOI values Ixx, Iyy, and Izz determine how forgiving the club head 100 is for off-center impacts with a golf ball.

A "driver-type golf club head," also referred to as a driver, as described herein, can be defined by specific dimensional ranges. In particular, the driver, as described with regard to the invention disclosed herein, includes a loft angle and volume within the ranges defined below. The specified ranges below limit the driver-type golf club head to a driver-type club head. In other words, the driver-type golf club head cannot be a fairway-type, a hybrid-type, an iron-type, or a putter-type golf club head.

The "loft angle" of the driver as defined herein can be less than approximately 16 degrees, less than approximately 15 degrees, less than approximately 14 degrees, less than approximately 13 degrees, less than approximately 12 degrees, less than approximately 11 degrees, or less than approximately 10 degrees.

The "volume" of the driver as defined herein can be greater than approximately 300 $cm^3$, greater than approximately 350 $cm^3$, greater than approximately 400 $cm^3$, greater than approximately 425 $cm^3$, greater than approximately 450 $cm^3$, greater than approximately 475 $cm^3$, greater than approximately 500 $cm^3$, greater than approximately 525 $cm^3$, greater than approximately 550 $cm^3$, greater than approximately 575 $cm^3$, greater than approximately 600 $cm^3$, greater than approximately 625 $cm^3$, greater than approximately 650 $cm^3$, greater than approximately 675 $cm^3$, or greater than approximately 700 $cm^3$.

A "fairway-type golf club head" as defined herein is a club head having particular lofts, volumes, and dimensions that can be defined by specific dimensional ranges. In particular, the fairway-type club head, as described with regard to the invention disclosed herein, includes a loft angle and volume within the ranges defined below. The specified ranges below limit the fairway-type golf club head to a fairway-type club head. In other words, the fairway-type golf club head cannot be a driver type, a hybrid-type, an iron-type, or a putter-type golf club head.

The "loft angle" of the fairway-type club head as defined herein can be less than approximately 35 degrees, less than approximately 34 degrees, less than approximately 33 degrees, less than approximately 32 degrees, less than approximately 31 degrees, or less than approximately 30 degrees. In some embodiments, the loft angle of the fairway-type golf club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway-type golf club head can be between 14 degrees and 35 degrees, between 15 degrees and 35 degrees, between 20 degrees and 35 degrees, or between 12 degrees and 30 degrees.

The "volume" of the fairway-type club as defined herein can be less than approximately 170 $cm^3$, less than approximately 180 $cm^3$, less than approximately 190 $cm^3$, or less than approximately 200 $cm^3$. However, the volume of the fairway-type club cannot be less than 160 $cm^3$. In some embodiments, the volume of the fairway-type club head can be between approximately 150 $cm^3$ to 200 $cm^3$, between approximately 160 $cm^3$ to 170 $cm^3$, between approximately 160 $cm^3$ to 180 $cm^3$, or between approximately 170 $cm^3$ to 190 $cm^3$. The volume of the fairway-type club cannot be greater than 200 $cm^3$. In one exemplary embodiment, the volume of the fairway-type club is 169 $cm^3$.

A "hybrid-type golf club head" as defined herein is a club head having particular lofts, volumes, and dimensions that can be defined by specific dimensional ranges. In particular, the fairway-type club head, as described with regard to the invention disclosed herein, includes a loft angle and volume within the ranges defined below. The specified ranges below limit the hybrid-type golf club head to a hybrid-type club head. In other words, the hybrid-type golf club head cannot be a driver type, a fairway-type, an iron-type, or a putter-type golf club head.

The "loft angle" of the hybrid-type club head as defined herein can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of hybrid-type club heads can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The "volume" of the hybrid-type club head as defined herein can be less than approximately 200 cc, less than approximately 175 cc, less than approximately 150 cc, less than approximately 125 cc, less than approximately 100 cc, or less than approximately 75 cc. In some embodiments, the volume of hybrid-type club heads can be approximately 100 cc-150 cc, approximately 75 cc-150 cc, approximately 100 cc-125 cc, or approximately 75 cc-125 cc.

DESCRIPTION

I. General Golf Club Head Construction

Figure 3:
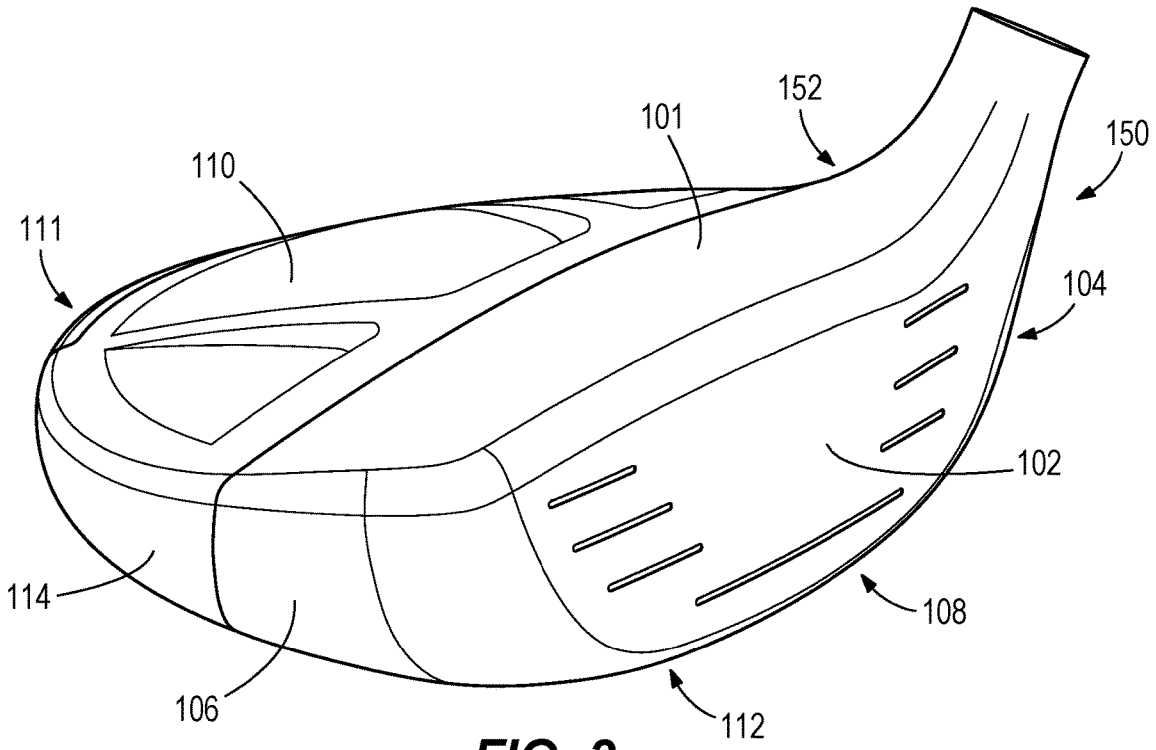
FIG. 3 illustrates a front perspective view of a wood-type golf club head in accordance with the present invention.

Described herein are various embodiments of a lightweight shaft-receiving structure that can be applied to a wood-type golf club head to create discretionary mass and improve the club head mass properties. The lightweight shaft-receiving structure can be applied to a wood-type golf club head. Referring to the drawings, club head 100 is used to illustrate generic features of any club head to which any of the below-described lightweight shaft-receiving structures can be applied. FIGS. 3-6 schematically illustrate a wood-type golf club head 100 in various views. Specifically, FIG. 3 illustrates a front perspective view of a wood-type club head 100. The club head 100 can comprise a strike face 102 and a body 101 secured together to define a substantially closed/hollow interior cavity 107 (illustrated in FIG. 5). The club head 100 comprises a crown 110, a sole 112 opposite the crown 112, a heel 104, a toe 106 opposite the heel 104, a front 108, and a rear 111 opposite the front 108. The body 101 can further include a skirt 114 located between and adjoining the crown 110 and the sole 112, the skirt 114 extending from near the heel 104 to near the toe 106 of the club head 100.

The club head 100 is a wood-type club head such as a driver, fairway wood, or hybrid as described in this disclosure. Although the figures depict various illustrations of a fairway wood-type club head, it should be noted that the any of the lightweight shaft-receiving structures described herein can be applied to any wood-type club head, including driver-type or hybrid-type club heads. The strike face 102 and the body 101 can define an interior cavity 107 of the club head 100. The body 101 can extend over the crown 110, the sole 112, the heel 104, the toe 106, the rear 111, and a perimeter of the front 108. In these embodiments, the body 101 defines an opening in the front 108 of the club head 100 and the strike face 102 is positioned within the opening to form the club head 100. In other embodiments, the strike face 102 extends over the perimeter of the front 108 and can include a return portion 122 extending rearward from the strike face 102. The return portion 122 can extend over at least one of the crown 110, the sole 112, the heel 104, and the toe 106. In embodiments comprising the return portion 122, the return portion 122 of the strike face 102 is secured to the body 101 to form the club head 100. In these embodiments, as illustrated in FIG. 3, the club head 100 can resemble a cup face or face wrap design.

Figure 2:
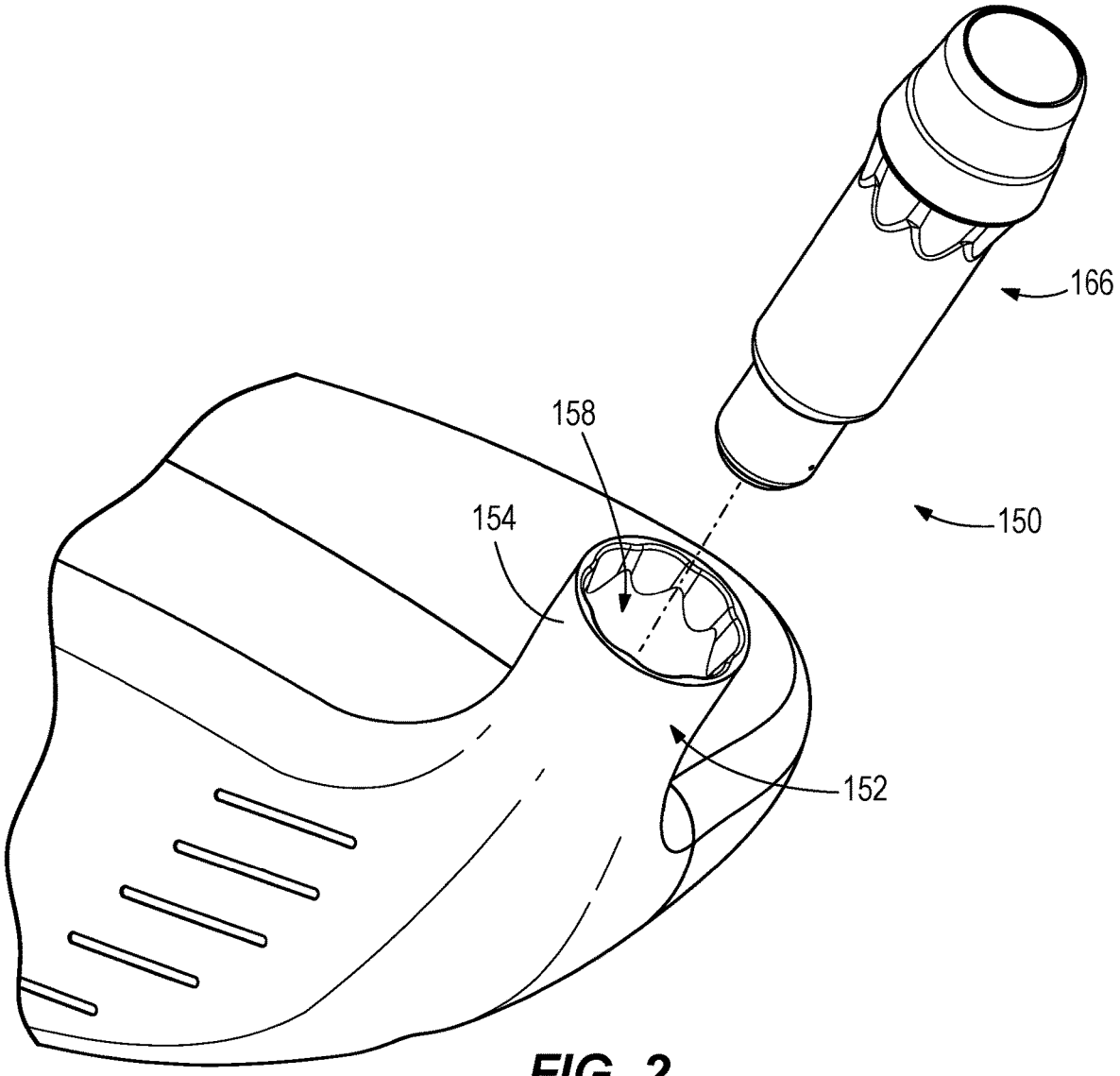
FIG. 2 PRIOR ART
FIG. 2 illustrates an exploded detail view of the prior-art shaft-receiving structure of FIG. 1.

As described above and illustrated in FIGS. 1 and 2, the club head 100 comprises a shaft-receiving structure 150. The shaft-receiving structure 150 comprises a hosel 152 capable of receiving a shaft sleeve 166 and a golf shaft (not shown), wherein the shaft sleeve 166 can be coupled to an end of the golf shaft (not shown). The shaft sleeve 166 can be coupled with the hosel 152 in a plurality of configurations, thereby permitting the golf shaft to be secured to the hosel 152 at a plurality of angles.

Figure 6:
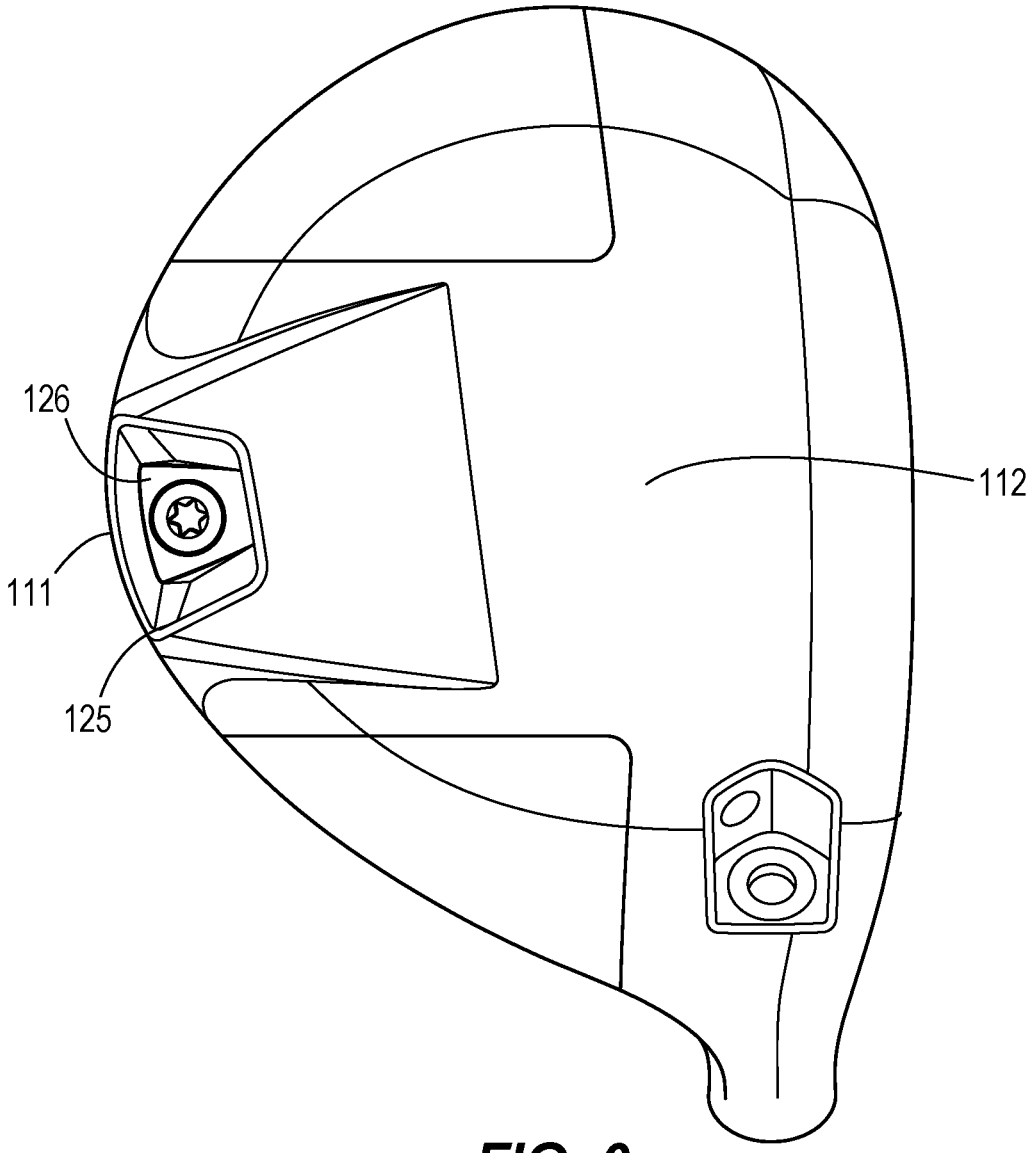
FIG. 6 illustrates a sole view of the wood-type golf club head of FIG. 3.

Referring to FIGS. 5 and 6, the club head 100 can comprise a weight port 125 configured to receive a removable weight 126. In many embodiments, the weight port 125 can be located in the sole 112 and/or in the skirt 114, proximate the rear 111. The club head 100 can further comprise a mass pad 163 or weight pad (hereafter "mass pad"). In many embodiments, the mass pad 163 can be located on the sole 112 and within the interior cavity 107. In other embodiments, the mass pad 163 can be located on the sole 112 and skirt 114, and within the interior cavity 107. In other embodiments still, the club head 100 can comprise one or more weight ports 125, and one or more mass pads 163. The removable weight 126 and mass pad 163 can adjust the moment of inertia (MOI) properties and center of gravity (CG) location. In many embodiments, the discretionary mass created by the lightweight shaft-receiving structures described herein can be redistributed by adding mass to the removable weight 126 or the mass pad 163 to improve the club head mass properties.

In many embodiments, a significant portion of the club head body 101 can be formed of a metallic material. The lightweight shaft-receiving structures described herein can be applied to a club head 100 comprising a body 101 that is either completely metallic or made of multiple materials. In certain embodiments, the lightweight shaft-receiving structures described herein can be applied to a club head 100 wherein at least a portion of the body 101 is formed of a lightweight, non-metallic material. However, in the description of the various shaft-receiving structures below, the term "body material" is used in reference to the metallic material forming portions of the body.

The body material can comprise, but is not limited to, limited to, steel, steel alloys, stainless steel alloys, nickel, nickel alloys, cobalt, cobalt alloys, titanium alloys, an amorphous metal alloy, or other similar materials. For example, the body material can comprise, but is not limited to, Ti-8Al-1Mo-1V alloy, 17-4 stainless steel, C300, C350, Ni (Nickel)-Co (Cobalt)-Cr (Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, T9s+, or Ti-8-1-1 titanium alloy, an amorphous metal alloy, or other similar metals. The body material comprises a greater density than the lightweight material used to provide the lightweight components of the shaft-receiving structure. In general, the density of the body material can range between approximately 4 g/cm$^3$ and 10 g/cm$^3$. In many embodiments of the lightweight shaft-receiving structure described below, the shaft-receiving structure can be formed by a combination of body material and lightweight material.

II. Lightweight Shaft-Receiving Structure

In many prior art club heads, adjustable shaft-receiving structures comprise various components integrally formed together from the body material. The material of the shaft-receiving structure is typically the same material as at least a large portion of the club head body and is typically a material suitable for casting, such as a steel or titanium alloy. In many prior art multi-material club heads, the shaft-receiving structure is integrally formed with the metal component of the body and comprises the same metallic material as the body. The metallic body material is necessary in many portions of the body (such as the sole, the crown return, the rear, etc.) for durability and mass distribution purposes. However, because certain portions of the shaft-receiving structure (i.e. the hosel tube) do not bear significant portions of the impact load, said portions do not need to be formed entirely of the body material. As discussed in further detail below, the shaft-receiving structure does not have the same strength requirements as the sole, crown return, or other portions of the club head that are formed by the body. As an example, any stresses imparted to the golf club head during use through the shaft are transmitted through the shaft sleeve at the contact points of the hosel bore opening and the hosel base. Because the hosel tube is not in contact with the shaft sleeve, the hosel tube bears only a small amount of the golf swing stress loading. Therefore, portions of the shaft-receiving structure such as the hosel tube can be provided with lightweight material without jeopardizing the structural integrity of the golf club head.

Because portions of the golf club head in and around the shaft receiving structure are under less stress when the club head is used to strike a golf ball, those portions do not require the same material properties as the portions of the golf club head that bear higher stresses during impact with a golf ball. Consequently, materials having a lower material strength, but also a lower density (lighter weight), can replace the portions of the shaft receiving structure that are under less stress.

The lightweight adjustable shaft-receiving structure creates discretionary mass by providing lightweight components in replacement of portions of the shaft-receiving structure typically formed of body material (or removing said components entirely in some cases). In many embodiments, portions of the hosel body, hosel transition, hosel tube, and/or hosel base can be constructed from lightweight materials. Such components can be constructed from lightweight materials (i.e. materials lighter than the material of the body) in order to reduce the mass of the shaft-receiving structure.

The lightweight shaft-receiving structure can comprise one or more portions or components constructed of a lightweight material having a density lower than that of the body material. In many embodiments, one or more portions or components of the lightweight shaft-receiving structure can be formed of a polymeric material, a composite material, or a lightweight metallic material having a density lower than that of the metal forming the body. In many embodiments, one or more portions or components of the lightweight shaft-receiving structure can be formed of a material including, but not limited to, a polymeric resin or a fiber-reinforced polymeric resin. The polymer resin can comprise a thermoset or a thermoplastic resin, a filled thermoplastic, a fiber-reinforced composite, a thermoplastic polyurethane (TPU) or a thermoplastic elastomer (TPE). For example, the resin can comprise polyphenylene sulfide (PPS), polyetheretherketone (PEEK), polyimides, polyamides such as PA6 or PA66, polyamide-imides, polyphenylene sulfides (PPS), polycarbonates, polyvinyl chloride (PVC), silicone or silicone plastic, nylon, nylon 6, nylon 66, ABS, polystyrene, acrylics, engineering polyurethanes, and/or other similar materials. In some embodiments, the one or more portions or components of the lightweight shaft-receiving structure can be formed of a lightweight metallic material including, but not limited to, aluminum or aluminum alloys, magnesium or magnesium alloys, and/or any other suitable lightweight alloy. Any of the components described as being formed of a "lightweight" material in the following embodiments can comprise any one or combination of the above materials.

One or more portions or components of the lightweight shaft-receiving structure can comprise a density significantly less than the density of the body material. In many embodiments, the density of the lightweight material forming the one or more lightweight components of the shaft-receiving structure can be less than approximately 3 g/cm$^3$. In many embodiments, the density of the lightweight material forming one or more of the lightweight components can be less than 2.75 g/cm$^3$, less than 2.50 g/cm$^3$, less than 2.25 g/cm$^3$, less than 2.00 g/cm$^3$, less than 1.75 g/cm$^3$, less than 1.50 g/cm$^3$, less than 1.25 g/cm$^3$, less than 1.00 g/cm$^3$, less than 0.75 g/cm$^3$, or less than 0.50 g/cm$^3$. Forming portions of the shaft-receiving structure with a lightweight material that would otherwise be formed of body material reduces the overall mass of the shaft-receiving structure.

As such, the benefit of the lightweight shaft-receiving structure is only realized when various embodiments of the shaft-receiving structure described herein are applied to golf club heads comprising at least a partially metallic body. For example, the lightweight shaft-receiving structure is applicable and beneficial in a fully metallic club head or in a multi-component component club head comprising a metallic component that would normally form the shaft-receiving structure. For example, the lightweight shaft-receiving structure would not provide particular benefit if applied to an entirely composite golf club head, as there would be no high-density body material in the shaft-receiving structure to replace with lightweight material. Although the shaft-receiving structures described herein are illustrated on a multi-material club head body, it should be noted that any of said shaft-receiving structures can alternatively be applied to a single-material or completely metallic club head body.

The lightweight shaft-receiving structure may be formed of a combination of body material and lightweight material. As such, the body material may still form certain portions of the shaft-receiving structure, whereas the remainder of the shaft-receiving structure can be formed of separate components comprising a lightweight material. The inclusion of lightweight material creates discretionary mass over a shaft-receiving structure formed entirely by body material.

The benefit of the lightweight shaft-receiving structure is the creation of discretionary mass that can be redistributed throughout the golf club head. The lightweight shaft-receiving structure can create between 3 grams and 12 grams of discretionary mass. In some embodiments, the lightweight shaft-receiving structure can create between 3 and 6 grams, between 4 and 7 grams, between 5 and 8 grams, between 6 and 9 grams, between 7 and 10 grams, between 8 and 11 grams, or between 9 and 12 grams of discretionary mass. In some embodiments, the lightweight shaft-receiving structure can create greater than 3 grams, greater than 4 grams, greater than 5 grams, greater than 6 grams, greater than 7 grams, greater than 8 grams, greater than 8 grams, greater than 10 grams, greater than 11 grams, or greater than 12 grams of discretionary mass.

The discretionary mass can be redistributed to advantageous locations in the golf club head to improve performance. The discretionary mass can be redistributed to alter the mass properties of the club head, such a providing a desirable CG location and/or increasing MOI.

In many embodiments, the discretionary mass created by the inclusion of the lightweight shaft-receiving structure can be redistributed to provide a lower CG position (i.e. a lower CGy). In many embodiments, the discretionary mass can be added to a mass pad on the sole to lower the CG position. As such, the club head can comprise a substantially heavy mass pad in the sole. In many embodiments, the mass pad can comprise a mass between 15 grams and 40 grams. In some embodiments, the mass pad can comprise a mass between 15 grams and 20 grams, between 20 grams and 25 grams, between 25 and 30 grams, between 30 and 35 grams, or between 35 and 40 grams. In some embodiments, the mass pad can comprise a mass greater than 15 grams, greater than 20 grams, greater than 25 grams, greater than 30 grams, greater than 35 grams, or greater than 40 grams.

In many embodiments, the discretionary mass created by the inclusion of the lightweight shaft-receiving structure can lead to increases in club head MOI over a similar club head with a prior-art shaft-receiving structure. The inclusion of the lightweight shaft-receiving structure disclosed herein provides a club head with a high MOI. In many embodiments, the discretionary mass can be added to a removable weight near the rear of the club head. Redistributing the mass saved by the lightweight shaft-receiving structure to the removable weight can increase the club head MOI. As such, the club head can comprise a substantially heavy removable weight proximate the rear. In many embodiments, the removable weight can comprise a mass between 1.0 gram and 35 grams. In some embodiments, the mass of the removable weight can range from 1.0 gram to 20 grams, or 20 grams to 35 grams. In some embodiments, the mass of the removable weight can range from 1.0 gram to 15 grams, 5 grams to 20 grams, 10 grams to 25 grams, 15 grams to 30 grams, or 20 grams to 35 grams. For example, the mass of the removable weight can be 1.0 gram, 1.5 grams, 2.0 grams, 3.0 grams, 4.0 grams, 5.0 grams, 6.0 grams, 7.0 grams, 8.0 grams, 9.0 grams, 10 grams, 11 grams, 12 grams, 13 grams, 14 grams, 15 grams, 16 grams, 17 grams, 18 grams, 19 grams, 20 grams, 21 grams, 22 grams, 23, grams, 24, grams, 25 grams, 26 grams, 27 grams, 28 grams, 29, grams, 30 grams, 31 grams, 32 grams, 33 grams, 34 grams, or 35 grams.

In many embodiments, a driver-type club head comprising the lightweight shaft-receiving structure can comprise an Ixx moment of inertia between 3000 g*cm$^2$ and 4800 g*cm$^2$. In some embodiments, a driver-type club head comprising the lightweight shaft-receiving structure can comprise an Ixx moment of inertia between than 3000 g*cm$^2$ and 3200 g*cm$^2$, between 3200 g*cm$^2$ and 3400 g*cm$^2$, between 3400 g*cm$^2$ and 3600 g*cm$^2$, between 3600 g*cm$^2$ and 3800 g*cm$^2$, between 3800 g*cm$^2$ and 4000 g*cm$^2$, between 4000 g*cm$^2$ and 4200 g*cm$^2$, between 4200 g*cm$^2$ and 4400 g*cm$^2$, between 4400 g*cm$^2$ and 4600 g*cm$^2$, or between 4600 g*cm$^2$ and 4800 g*cm$^2$.

In some embodiments, a driver-type club head comprising the lightweight shaft-receiving structure can comprise an Iyy moment of inertia between 4500 g*cm$^2$ and 6000 g*cm$^2$. In some embodiments, a driver-type club head comprising the lightweight shaft-receiving structure can comprise an Iyy moment of inertia between than 4500 g*cm$^2$ and 5000 g*cm$^2$, between 4600 g*cm$^2$ and 5100 g*cm$^2$, between 4700 g*cm$^2$ and 5200 g*cm$^2$, between 4800 g*cm$^2$ and 5300 g*cm$^2$, between 4900 g*cm$^2$ and 5400 g*cm$^2$, between 5000 g*cm$^2$ and 5500 g*cm$^2$, between 5100 g*cm$^2$ and 5600 g*cm$^2$, between 5200 g*cm$^2$ and 5700 g*cm$^2$, between 5300 g*cm$^2$ and 5800 g*cm$^2$, between 5400 g*cm$^2$ and 5900 g*cm$^2$, or between 5500 g*cm$^2$ and 6000 g*cm$^2$.

In some embodiments, a driver-type club head comprising the lightweight shaft-receiving structure can comprise an Izz moment of inertia between 2400 g*cm$^2$ and 3000 g*cm$^2$. In some embodiments, a driver-type club head comprising the lightweight shaft-receiving structure can comprise an Izz moment of inertia between 2400 g*cm$^2$ and 2500 g*cm$^2$, between 2500 g*cm$^2$ and 2600 g*cm$^2$, between 2600 g*cm$^2$ and 2700 g*cm$^2$, between 2700 g*cm$^2$ and 2800 g*cm$^2$, between 2800 g*cm$^2$ and 2900 g*cm$^2$, or between 2900 g*cm$^2$ and 3000 g*cm$^2$.

In many embodiments, a fairway wood-type club head comprising the lightweight shaft-receiving structure can comprise an Ixx moment of inertia between 1400 g*cm$^2$ and 2200 g*cm$^2$. In some embodiments, a fairway wood-type club head comprising the lightweight shaft-receiving structure can comprise an Ixx moment of inertia between than 1400 g*cm$^2$ and 1500 g*cm$^2$, between 1500 g*cm$^2$ and 1600 g*cm$^2$, between 1600 g*cm$^2$ and 1700 g*cm$^2$, between 1700 g*cm$^2$ and 1800 g*cm$^2$, between 1800 g*cm$^2$ and 1900 g*cm$^2$, between 1900 g*cm$^2$ and 2000 g*cm$^2$, between 2000 g*cm$^2$ and 2100 g*cm$^2$, or between 2100 g*cm$^2$ and 2200 g*cm$^2$.

In some embodiments, a fairway wood-type club head comprising the lightweight shaft-receiving structure can comprise an Iyy moment of inertia between 2800 g*cm$^2$ and 4000 g*cm$^2$. In some embodiments, a fairway wood-type club head comprising the lightweight shaft-receiving structure can comprise an Iyy moment of inertia between than 2900 g*cm$^2$ and 4000 g*cm$^2$, between 3000 g*cm$^2$ and 3200 g*cm$^2$, between 3100 g*cm$^2$ and 3300 g*cm$^2$, between 3200 g*cm$^2$ and 3400 g*cm$^2$, between 3300 g*cm$^2$ and 3500 g*cm$^2$, between 3400 g*cm$^2$ and 3600 g*cm$^2$, between 3500 g*cm$^2$ and 3700 g*cm$^2$, between 3600 g*cm$^2$ and 3800 g*cm$^2$, between 3700 g*cm$^2$ and 3900 g*cm$^2$, or between 3800 g*cm$^2$ and 4000 g*cm$^2$.

In some embodiments, a fairway wood-type club head comprising the lightweight shaft-receiving structure can comprise an Izz moment of inertia between 1600 g*cm$^2$ and 2400 g*cm$^2$. In some embodiments, a fairway wood-type club head comprising the lightweight shaft-receiving structure can comprise an Izz moment of inertia between 1600 g*cm$^2$ and 1700 g*cm$^2$, between 1700 g*cm$^2$ and 1800 g*cm$^2$, between 1800 g*cm$^2$ and 1900 g*cm$^2$, between 1900 g*cm$^2$ and 2000 g*cm$^2$, between 2000 g*cm$^2$ and 2100 g*cm$^2$, between 2100 g*cm$^2$ and 2200 g*cm$^2$ between 2200 g*cm$^2$ and 2300 g*cm$^2$, or between 2300 g*cm$^2$ and 2400 g*cm$^2$.

In many embodiments, a hybrid-type club head comprising the lightweight shaft-receiving structure can comprise an Ixx moment of inertia between 750 g*cm$^2$ and 1000 g*cm$^2$. In some embodiments, a hybrid-type club head comprising the lightweight shaft-receiving structure can comprise an Ixx moment of inertia between than 750 g*cm$^2$ and 800 g*cm$^2$, between 800 g*cm$^2$ and 850 g*cm$^2$, between 850 g*cm$^2$ and 900 g*cm$^2$, between 900 g*cm$^2$ and 950 g*cm$^2$, or between 950 g*cm$^2$ and 1000 g*cm$^2$.

In some embodiments, a hybrid-type club head comprising the lightweight shaft-receiving structure can comprise an Iyy moment of inertia between 2500 g*cm$^2$ and 3200 g*cm$^2$. In some embodiments, a hybrid-type club head comprising the lightweight shaft-receiving structure can comprise an Iyy moment of inertia between than 2500 g*cm$^2$ and 2600 g*cm$^2$, between 2600 g*cm$^2$ and 2700 g*cm$^2$, between 2700 g*cm$^2$ and 2800 g*cm$^2$, between 2800 g*cm$^2$ and 2900 g*cm$^2$, between 2900 g*cm$^2$ and 3000 g*cm$^2$, between 3000 g*cm$^2$ and 3100 g*cm$^2$, or between 3100 g*cm$^2$ and 3200 g*cm$^2$.

In some embodiments, a hybrid-type club head comprising the lightweight shaft-receiving structure can comprise an Izz moment of inertia between 2200 g*cm$^2$ and 3000 g*cm$^2$. In some embodiments, a hybrid-type club head comprising the lightweight shaft-receiving structure can comprise an Izz moment of inertia between 2200 g*cm$^2$ and 2300 g*cm$^2$, between 2300 g*cm$^2$ and 2400 g*cm$^2$, between 2400 g*cm$^2$ and 2500 g*cm$^2$, between 2500 g*cm$^2$ and 2600 g*cm$^2$, between 2600 g*cm$^2$ and 2700 g*cm$^2$, between 2700 g*cm$^2$ and 2800 g*cm$^2$, between 2800 g*cm$^2$ and 2900 g*cm$^2$, or between 2900 g*cm$^2$ and 3000 g*cm$^2$.

Further, the discretionary mass created by the inclusion of the lightweight shaft-receiving structure can allow mass to be repositioned to provide a more desirable CG position. In many embodiments, discretionary mass can be reallocated to lower the CG height and/or increase the CG depth. Lowering the CG height can improve the performance characteristics of the club head, by increasing the launch angle, decreasing the ball spin rate, and/or improving ball speed.

In many embodiments, a driver-type club head comprising the lightweight shaft-receiving structure can comprise a CG height between 0 inch and −0.300 inch. In some embodiments, a driver-type club head comprising the lightweight shaft-receiving structure can comprise a CG height between 0 inch and −0.050 inch, between −0.050 inch and −0.100 inch, between −0.100 inch and −0.150 inch, between −0.150 inch and −0.200 inch, between −0.200 inch and −0.250 inch, or between −0.250 inch and −0.300 inch.

In many embodiments, a driver-type club head comprising the lightweight shaft-receiving structure can comprise a CG depth between 1.25 inch and 2.00 inches. In some embodiments, a driver-type club head comprising the lightweight shaft-receiving structure can comprise a CG depth between 1.25 inch and 1.75 inch, between 1.30 inch and 1.80 inch, between 1.35 inch and 1.85 inch, between 1.40 inch and 1.90 inch, between 1.45 inch and 1.95 inch, or between 1.50 inch and 2.00 inch.

In many embodiments, a fairway wood-type club head comprising the lightweight shaft-receiving structure can comprise a CG height between −0.140 inch and −0.200 inch. In some embodiments, a fairway wood-type club head comprising the lightweight shaft-receiving structure can comprise a CG height between −0.140 inch and −0.145 inch, between −0.145 inch and −0.150 inch, between −0.150 inch and −0.155 inch, between −0.155 inch and −0.160 inch, between −0.160 inch and −0.165 inch, between −0.165 inch and −0.170 inch, between −0.170 inch and −0.175 inch, between −0.175 inch and −0.180 inch, between −0.180 inch and −0.185 inch, between −0.185 inch and −0.190 inch, between −0.190 inch and −0.195 inch, or between −0.195 inch and −0.200 inch, In many embodiments, a fairway wood-type club head comprising the lightweight shaft-receiving structure can comprise a CG depth between 1.00 inch and 1.50 inch. In some embodiments, a fairway wood-type club head comprising the lightweight shaft-receiving structure can comprise a CG depth between 1.00 inch and 1.05 inch, between 1.05 inch and 1.10 inch, between 1.10 inch and 1.15 inch, between 1.15 inch and 1.20 inch, between 1.20 inch and 1.25 inch, between 1.25 inch and 1.30 inch, between 1.30 inch and 1.35 inch, between 1.35 inch and 1.40 inch, between 1.40 inch and 1.45 inch, or between 1.45 inch and 1.50 inch In many embodiments, a hybrid-type club head comprising the lightweight shaft-receiving structure can comprise a CG height between −0.220 inch and −0.320 inch. In some embodiments, a hybrid-type club head comprising the lightweight shaft-receiving structure can comprise a CG height between −0.220 inch and −0.230 inch, between −0.230 inch and −0.240 inch, between −0.240 inch and −0.250 inch, between −0.250 inch and −0.260 inch, between −0.260 inch and −0.270 inch, between −0.270 inch and −0.280 inch, between −0.280 inch and −0.290 inch, between −0.290 inch and −0.300 inch, between −0.300 inch and −0.310 inch, or between −0.310 inch and −0.320 inch.

In many embodiments, a hybrid-type club head comprising the lightweight shaft-receiving structure can comprise a CG depth between 0.900 inch and 1.25 inch. In some embodiments, a hybrid-type club head comprising the lightweight shaft-receiving structure can comprise a CG depth between 0.900 inch and 1.00 inch, between 0.925 inch and 1.025 inch, between 0.950 inch and 1.050 inch, between 0.975 inch and 1.075 inch, between 1.00 inch and 1.100 inch, between 1.025 inch and 1.125 inch, between 1.050 inch and 1.150 inch, between 1.075 inch and 1.175 inch, between 1.100 inch and 1.200 inch, between 1.125 inch and 1.225 inch, or between 1.150 inch and 1.250 inch.

Figure 17A:
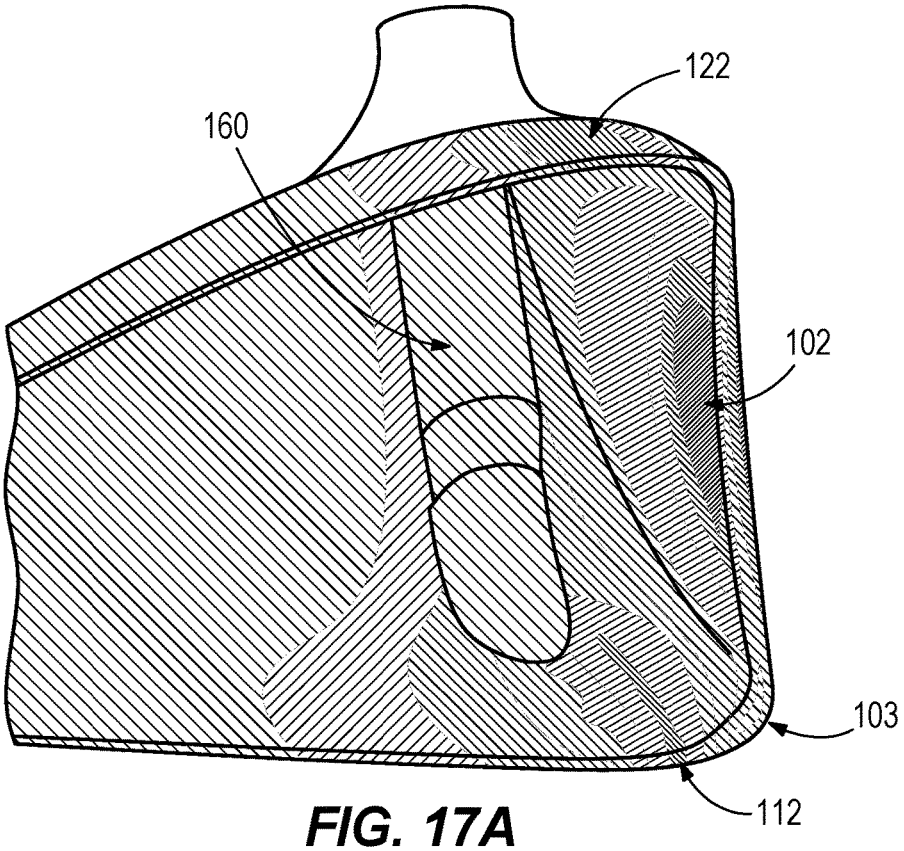
FIG. 17A illustrates the internal stresses occurring at impact of a prior art club head comprising a hosel tube.
Figure 17B:
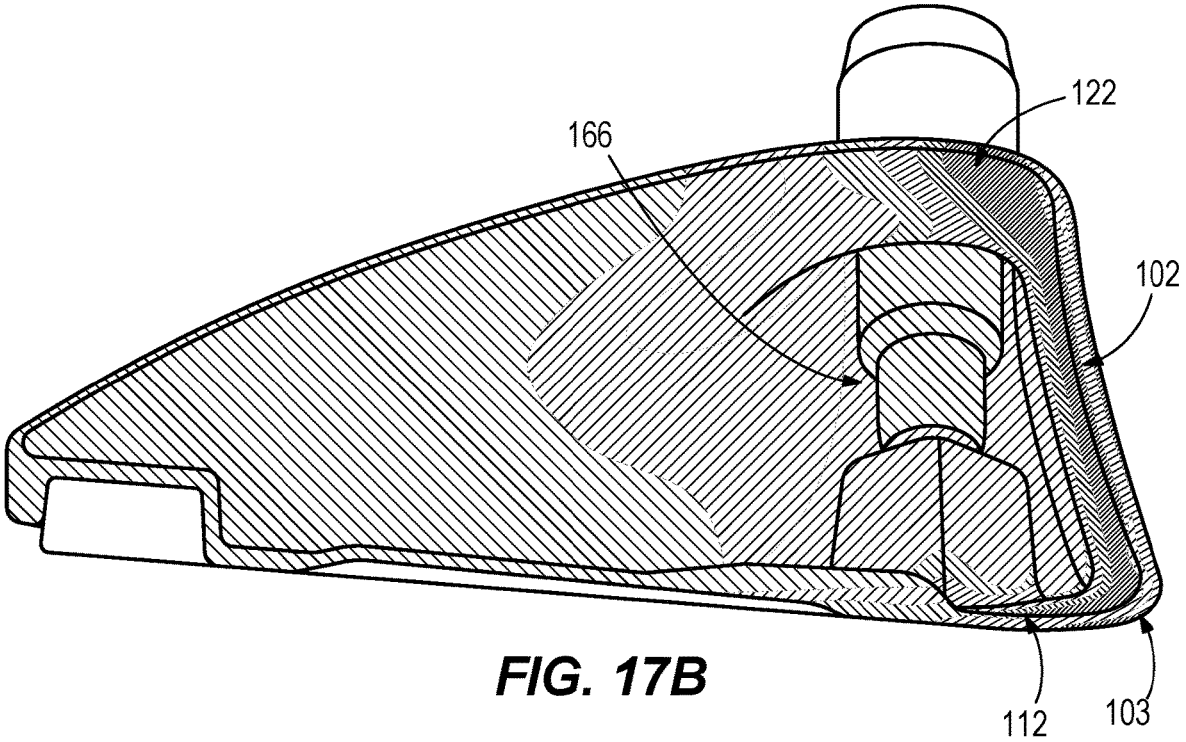
FIG. 17B illustrates the internal stresses occurring at impact of a club head similar to the club head of FIG. 17A, but devoid of the hosel tube.

The lightweight-shaft receiving structure can reduce the mass of portions of the prior-art shaft-receiving structures that do not provide structural support. Referring to FIGS. 17A and 17B, certain portions of the prior-art shaft-receiving structures bear a negligible amount of stress loading at impact. Referring to FIG. 17A, the highest stress at impact occurs on the strikeface near the strikeface center. As shown by changes in the cross-hatching pattern, areas of progressively lower stress at impact are shown around the area of highest stress. The rearmost portion of the golf club head and the shaft receiving structure interior to the golf club head share a lighter cross-hatching pattern indicating the lowest stress areas at impact. As shown in FIG. 17B, even when the hosel tube 160 is removed, the shaft receiving structure interior to the golf club head still bear the lowest stress at impact.

Figure 18B:
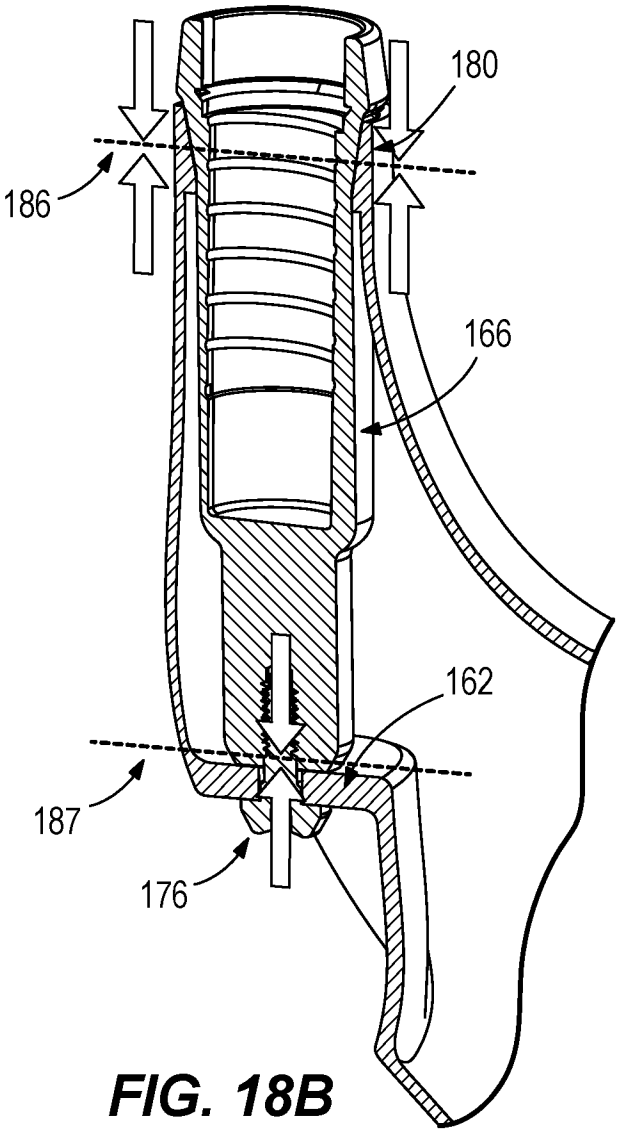
FIGS. 18A and 18B illustrate an internal view of the shaft-receiving structure of a wood-type golf club head.
Figure 18A:
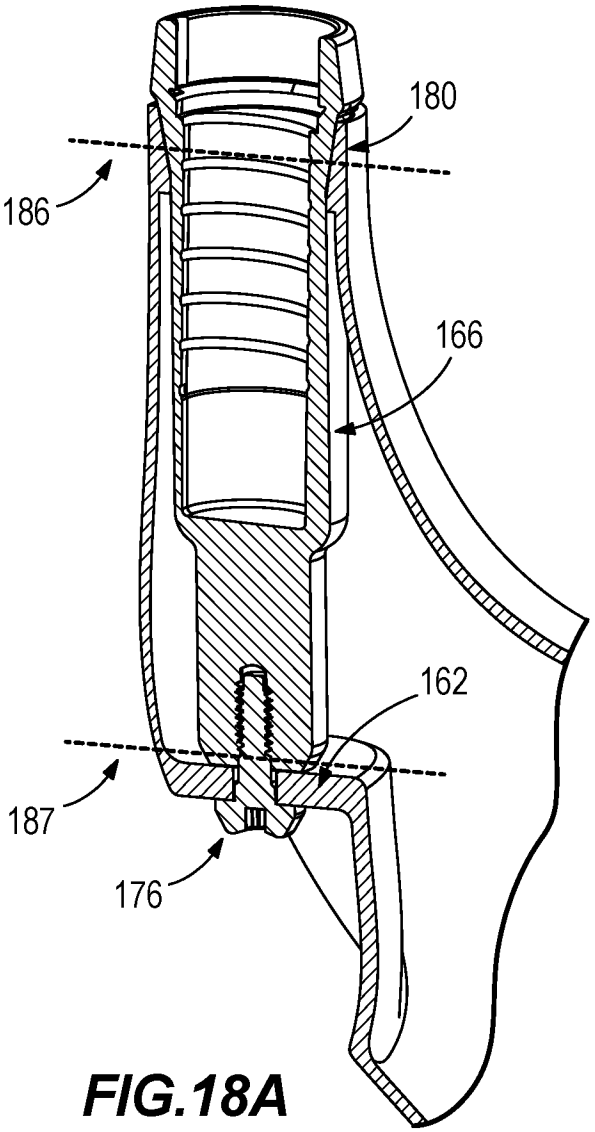

Some embodiments of shaft-receiving structures comprise portions that also are not required for retaining a golf shaft within the hosel bore. Referring to FIGS. 18A and 18B, when the shaft sleeve 166 is coupled with the golf club head 100, the shaft sleeve 166 is secured in tension by the downward force exerted by the threaded fastener 176 as it is tightened. The forces on the upper portion of the shaft sleeve 166 can be analyzed by simplifying the contact of the upper portion of the shaft sleeve 166 with an upper portion of the hosel wall 154 (proximate the hosel bore opening 158) as occurring at an upper contact plane 186. The forces on the lower portion of the shaft sleeve 166 can be analyzed by simplifying the contact of the lower portion of the shaft sleeve 166 as occurring at a lower contact plane 187. FIG. 18B illustrates that the force acting on the shaft sleeve 166 upper portion is offset or balanced at the hosel wall 154 upper end (proximate the hosel bore opening 158), which does not involve the hosel tube 160. FIG. 18B further illustrates that the force acting on the shaft sleeve 166 lower portion is offset or balanced at the hosel base 162 and also does not involve the hosel tube 160. This illustrates that the hosel tube 160 does not provide support needed for the retention of the shaft within the hosel of the golf club head 100.

Various embodiments of shaft-receiving structures comprising lightweight components are presented in further detail below. The various embodiments are differentiated in reference to the portions of the prior art shaft-receiving structures that are replaced by lightweight components or removed entirely. The various embodiments are further differentiated by the overall amount of discretionary mass created over a prior art shaft-receiving structure. In many embodiments, some or all of the mass of the hosel, the hosel wall, the hosel tube, and/or the hosel base can be replaced with a lightweight material or lightweight component. Different embodiments comprise different combinations of shaft-receiving structure portions that are replaced by lightweight components. Different embodiments balance the desire to create the greatest amount of discretionary mass with the need to provide loft angle and lie angle adjustability, the need to seal the interior cavity, and the desire for a simple manufacturing and/or assembly process. Further benefit of the lightweight shaft-receiving structure can include the removal of expensive body material to be replaced by lightweight components. As such, providing the lightweight shaft-receiving structure can reduce the cost of manufacturing the club head.

III. Lightweight Shaft-Receiving Structure with Lower End Cap

Figure 7:
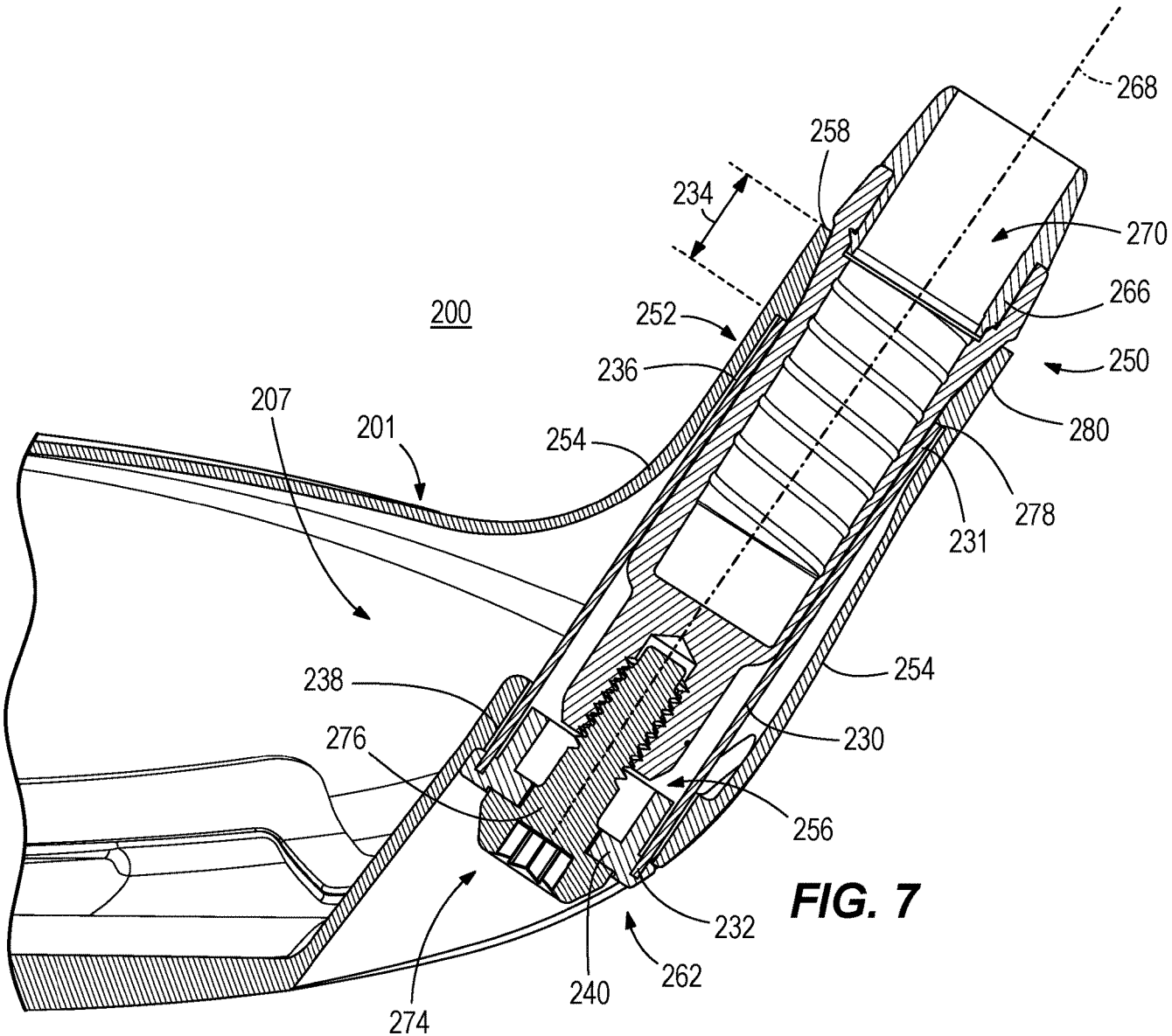
FIG. 7 illustrates a front cross-sectional view of a lightweight shaft-receiving structure comprising a tube insert and a lower end cap.
Figure 8:
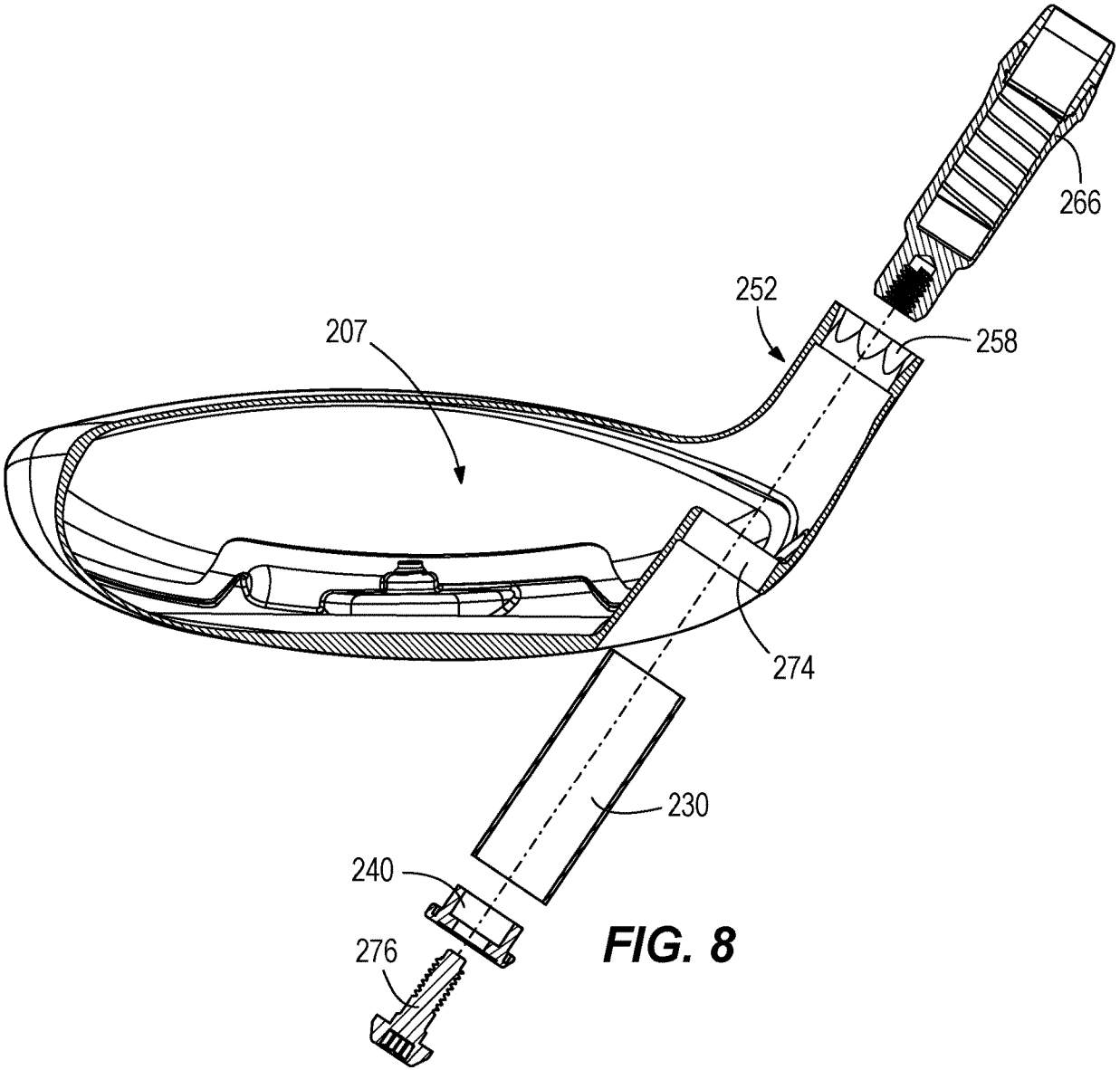
FIG. 8 illustrates an exploded cross-sectional view of the lightweight shaft-receiving structure of FIG. 7.
Figure 9:
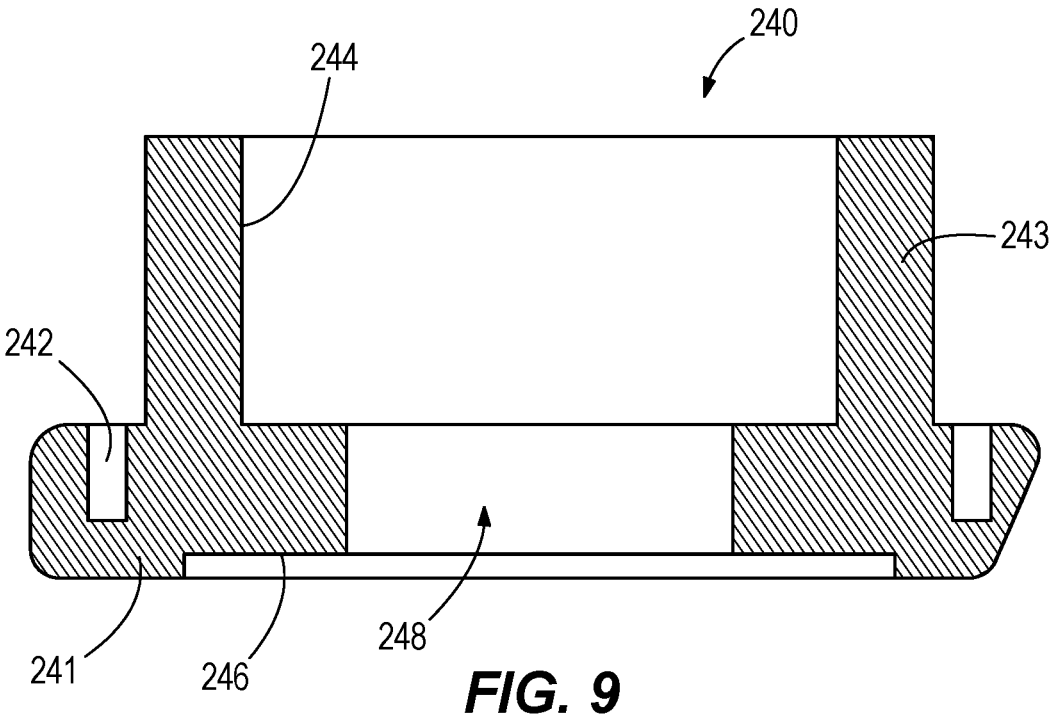
FIG. 9 illustrates a cross-sectional detail view of the lower end cap of FIG. 7.

FIGS. 7-9 illustrate a first embodiment of a wood-type golf club head comprising a lightweight adjustable shaft-receiving structure 250 that replaces the hosel tube, the hosel base, and portions of the hosel wall 254 with lightweight components. Such lightweight components can be formed from materials less dense than the material of the body 201, such as the lightweight materials described above. The lightweight shaft-receiving structure 250 can comprise a mass reduced by 3 to 12 grams in comparison to a similar-shaft receiving structure formed entirely of body material. Reducing the mass of the shaft-receiving structure 250 by forming components out of lightweight material rather than body material frees up discretionary mass to be re-allocated to other areas of the club head 200 to improve mass properties and performance.

Referring to FIG. 7, the shaft-receiving structure 250 comprises a lightweight tube insert 230 that replaces the entirety of the hosel tube and portions of the hosel wall 254. In many embodiments, the tube insert 230 is a perfectly cylindrical tube located within the interior cavity 207. the tube insert 230 is formed as a component separate from the hosel 252 and inserted into the interior cavity 207 during manufacture. The tube insert 230 can extend from near the hosel bore opening 258 all the way to the hosel base 262. The tube insert 230 reduces mass by replacing the mass of the hosel tube and at least a portion of the mass of the hosel wall 254 with a less dense material. As shown in FIG. 7, the tube insert 230 can replace portions of the hosel wall 254, such that the hosel wall 254 can be thinned out. Because the tube insert 230 is internally located within the interior cavity 207, the tube insert 230 replaces a majority of the hosel wall 254 inner surface. As illustrated in FIG. 7, the hosel wall 254 forms a hosel wall upper portion 280 proximate the hosel bore opening 258. In many embodiments, the tube insert 230 does not form any portion of the hosel wall upper portion 280 or the hosel bore opening 258. As such, the hosel bore upper portion 280 can be formed entirely by the hosel 252, which is a part of the club head body 201. Any receiving geometry required for adjustability of the shaft-receiving structure 250 can be formed by the hosel wall upper portion 280. For example, in some embodiments, the hosel upper wall portion 280 can form one or more lobes configured to receive one or more surface features of the shaft sleeve 266 and provide adjustability to the club head loft angle and/or lie angle. The tube insert 230 can extend from just below the hosel wall upper portion 280 all the way to the hosel base 262.

The tube insert 230 comprises an upper end 231 proximate the hosel wall upper portion 280 and a lower end 232 proximate the hosel base 262. In many embodiments, the tube insert 230 can comprise a tube insert length measured from the upper end 231 to the lower end 232, parallel to the hosel bore axis 268. In many embodiments, the tube insert length can be between 1.00 inch and 1.50 inch. In some embodiments, the tube insert length can be between 1.00 and 1.10 inch, between 1.10 inch and 1.20 inch, between 1.20 inch and 1.30 inch, between 1.30 inch and 1.40 inch, or between 1.40 inch and 1.50 inch.

In many embodiments, the length of the tube insert 230 can further be characterized relative to a distance between the hosel bore opening 258 and the hosel base 262 (hereafter referred to as the "hosel length"). The hosel length can be measured parallel to the hosel bore axis 268. In many embodiments, the tube insert length can be between 70% and 90% of the hosel length. In some embodiments, the tube insert length can be between 70% and 75%, between 75% and 80%, between 80% and 85%, or between 85% and 90% of the hosel length. The tube insert length is significant in relation to the hosel length. If the tube insert length is too short, discretionary mass will not be maximized. However, if the tube insert length is too long, the tube insert upper end 231 may be too close to the hosel bore opening 258, wherein the tube insert 230 may experience too high of stress at impact.

In order to not compromise the structural integrity of the club head 100, the tube insert 230 can be spaced away from the high-stress areas located proximate the hosel bore opening 258. The tube insert top end 231 can be offset from the topmost edge of the hosel bore opening 258 a tube insert offset distance 234. The tube offset distance 234 can be measured parallel to the hosel bore axis 268. In many embodiments, the tube insert offset distance 234 can be in a range of 0.150 inch to 0.350 inch. In some embodiments, the tube insert offset distance 234 can be between 0.150 and 0.200 inch, between 0.200 and 0.250 inch, between 0.250 and 0.300 inch, or between 0.300 and 0.350 inch. In some embodiments, the tube insert offset distance 234 can be 0.150 inch, 0.160 inch, 0.170 inch, 0.180 inch, 0.190 inch, 0.200 inch, 0.210 inch, 0.220 inch, 0.230 inch, 0.240 inch, 0.250 inch, 0.260 inch, 0.270 inch, 0.280 inch, 0.290 inch, 0.300 inch, 0.310 inch, 0.320, 0.330, 0.340, or 0.350 inch.

As discussed above in reference to FIGS. 17A and 17B, the stresses from a ball impacting the strike face 202 of the golf club head 200 are highest at the impact area near the strike face geometric center 220. As the distance from the impact point increases, the stress borne by the club head material decreases. As the stress is propagated through the material, FIGS. 17A and 17B illustrate that the stress propagates mainly through the outer surface of the golf club head 200, and decreases in the interior cavity 207 of the golf club head 200, as well as toward the rear 211 of the golf club head 201. The tube insert top end 231 is located away from the stress propagation. Likewise, the shaft sleeve 266 attachment point to the threaded fastener 276 at the hosel base 262 is also located away from the stress propagation. Thus, the points of contact between the shaft sleeve 266 and the golf club head 200 are in the lower stress areas. The tube insert 230, by virtue of being located within the interior cavity 207 and away from the exterior surfaces of the club head 200, is protected from high stresses at impact.

In the embodiment illustrated in FIGS. 7-9, the hosel wall 254 is thinned relative to the hosel wall upper portion 280. As such, a lip 278 is formed at the juncture of the hosel wall upper portion 180 and the remainder of the hosel wall 254. The lip 278 can be formed at a bottom end of the hosel wall upper portion 280. The lip 278 is created by an abrupt change in thickness between the hosel wall upper portion 280 and the thinned hosel wall 254. In many embodiments, the hosel wall upper portion 280 comprises a greater thickness (measured from an exterior surface of the hosel wall upper portion 280 to an interior surface of the hosel wall upper portion 280) than a thickness of the remainder of the hosel wall 254 (measured from an exterior surface of the hosel wall 254 to an interior surface of the hosel wall 254). The top end 231 of the tube insert 230 can be configured to abut the lip 278 formed by the hosel wall upper portion 280 and the hosel wall 254. The tube insert 230 therefore extends downward from the lip 278 into the interior cavity 207 and all the way to the hosel base 262.

Although the hosel bore opening 258 is formed by the hosel 252 itself, the majority of the hosel bore 256 is defined by the inner surface of the tube insert 230. In many embodiments, the hosel wall upper portion 280 forms the hosel bore opening 258 and an upper portion of the hosel bore 256 (i.e. the portion of the hosel bore 256 proximate the hosel bore opening 258) while the tube insert 230 forms a remainder of the hosel bore 280. The tube insert 230 completely separates the hosel bore 256 from the remainder of the interior cavity 207. The tube insert 230 is sealed on both the top end 231 and bottom end 232 at the lip 278 and the hosel base 262, respectively. The tube insert 230 completely seals the hosel bore 256 off from the interior cavity 207 such that no debris or other particulate can get into the interior cavity 207 through the hosel bore opening 258, even if the shaft sleeve 266 is removed. The seal created by the tube insert 230 also keeps water from entering the interior cavity 207 through the hosel bore opening 258. This can be especially important for keeping the interior surfaces of the club head 200 from rusting.

The tube insert 230 is formed of a lightweight material, as described above, with a lesser density than the density of the body material. Replacing the tube portion and portions of the hosel wall 254 with the lightweight tube insert 230 reduces the mass of the shaft-receiving structure 250 in comparison to a similar structure formed entirely of body material. The inclusion of the lightweight tube insert 230 provides structure for retaining the shaft and shaft sleeve 266 in the hosel bore 256 and sealing the hosel bore 256 from the interior cavity 207 while creating discretionary mass that can be redistributed in advantageous locations to improve the mass properties of the club head 200.

As mentioned above, the bottom end 232 of the tube insert 230 couples to the hosel base 262 and creates a seal. In the illustrated embodiment of FIGS. 7-9, the hosel base 262 is formed by a lightweight removable end cap 240. The end cap 240 can be formed as a separate component from both the club head body 201 and the tube insert 230. When fully assembled, the end cap 240 can cover the lower end 232 of the tube insert 230 and close off the lower opening 274, enclosing the tube insert 230 within the interior cavity 207 and holding it in place.

The end cap 240 can be constructed of a lightweight material, (said lightweight materials and the associated densities defined above can be applied to the end cap 240). In some embodiments, the material of the end cap 240 can be the same as the material of the tube insert 230. In other embodiments, the end cap 240 and the tube insert 230 can be formed of different lightweight materials.

In some embodiments, as illustrated in FIG. 9, the end cap 240 can comprise one or more alignment features configured to receive and center the tube insert 230 in relation to the end cap 240 and secure the tube insert 230 in place. In some embodiments, as illustrated in FIG. 9, the end cap 240 can form one or more notches 242 configured to receive the lower end 232 of the tube insert 230. In some embodiments, as illustrated in FIG. 9, the end cap 240 can further comprise a protrusion 243 extending upward from the end cap body 241 into the hosel bore 256. The protrusion 243 can be shaped to fit flush against the interior surface of the tube insert 230, aligning the end cap 240 with the hosel bore 256 formed within the tube insert 230. The end cap 240 further comprises an aperture 248 extending through the end cap body 241 from a bottom surface of the end cap body 241 to a top surface in the direction of the hosel bore 256. The aperture 248 is configured to receive the fastener 276 that couples the shaft sleeve 266. In some embodiments, the aperture 248 may or may not be threaded to correspond to a threaded fastener 278.

Forming hosel base 262 with the removable end cap 240 allows the tube insert 230 to be inserted into the interior cavity 207 through the lower opening 274, rather than requiring the tube insert 230 be inserted from the top through the hosel bore opening 258. Referring to FIGS. 7 and 8, the tube insert 230 can be inserted through the lower opening 274 such that the top end 231 of the tube insert 230 abuts the lip 278 of the hosel 252. The tube insert 230 can be retained in the interior cavity 207 by either mechanical or adhesive means. In some embodiments, the tube insert 230 is held in place by surrounding structures. As illustrated by FIGS. 7, the tube insert top end 231 is constrained from above by the lip 278, from an interior direction by the shaft sleeve 266, and from an outer direction by the hosel wall 254 below the lip 278. The tube insert bottom end is constrained from below by the hosel base 262, from an outer direction by the end cap 240, and from an interior direction by the bottom lap joint 238.

In many other embodiments, the tube insert 230 can be held in place by adhesive means. In such embodiments, the shaft-receiving structure 250 can form a plurality of lap joints near the bottom and top ends 232, 231 of the tube insert 230. FIG. 7 illustrates a bottom lap joint 238 formed by the club head body 201, between the bottom end 232 of the tube insert 230 and the hosel base 262 and a top lap joint 236 formed between the top end 231 of the tube insert 230 and the interior of the hosel 252 near the lip 276. The top lap joint 236 can be formed by the interior surface of the hosel wall 254 proximate the lip 278. The bottom lap joint 238 can extend upward from the hosel base 262 (which is formed by the end cap 240) and into the interior cavity 207. The bottom lap joint 238 can be configured such that an interior surface of the bottom lap joint 238 corresponds to tube insert 230 and provides a surface for the tube insert 230 to adhere to. The tube insert 230 and the club head body 201 can be epoxied or otherwise adhered together at both the top lap joint 236 and the bottom lap joint 238 such that the tube insert 230 remains secured in place, even when the fastener 276 is loosened and the shaft sleeve 266 is removed.

Insertion of the tube insert 230 through the lower opening 274 allows for a simplified manufacturing and assembly process. The tube insert 230 does not need to be inserted through the hosel bore opening 256, and therefore the hosel wall upper portion 280 and hosel bore opening 256 can be formed integrally with the remainder of the hosel 252. If not for the ability to insert the tube insert 230 through the lower opening 274, the hosel wall upper portion 280 and hosel bore opening 256 would need to be formed separately from the remainder of the hosel 252 and coupled thereto in order to enclose the top end 231 of the tube insert 230. The shaft-receiving structure 250 capable of receiving the tube insert 230 through the lower opening 274 therefore allows the geometry of the hosel 252, including any receiving geometries configured to receive the shaft sleeve 266, to be integrally cast as one piece.

As alluded to above, the inclusion of the lightweight components to replace portions of the shaft-receiving structure reduces the mass of the shaft-receiving structure. In some embodiments, the lightweight shaft-receiving structure creates between 3 grams and 12 grams of discretionary mass. The discretionary mass created by the lightweight shaft-receiving structure can be allocated throughout the club head to improve mass properties and performance.

IV. Lightweight Shaft-Receiving Structure with Lightweight Collar

Figure 10:
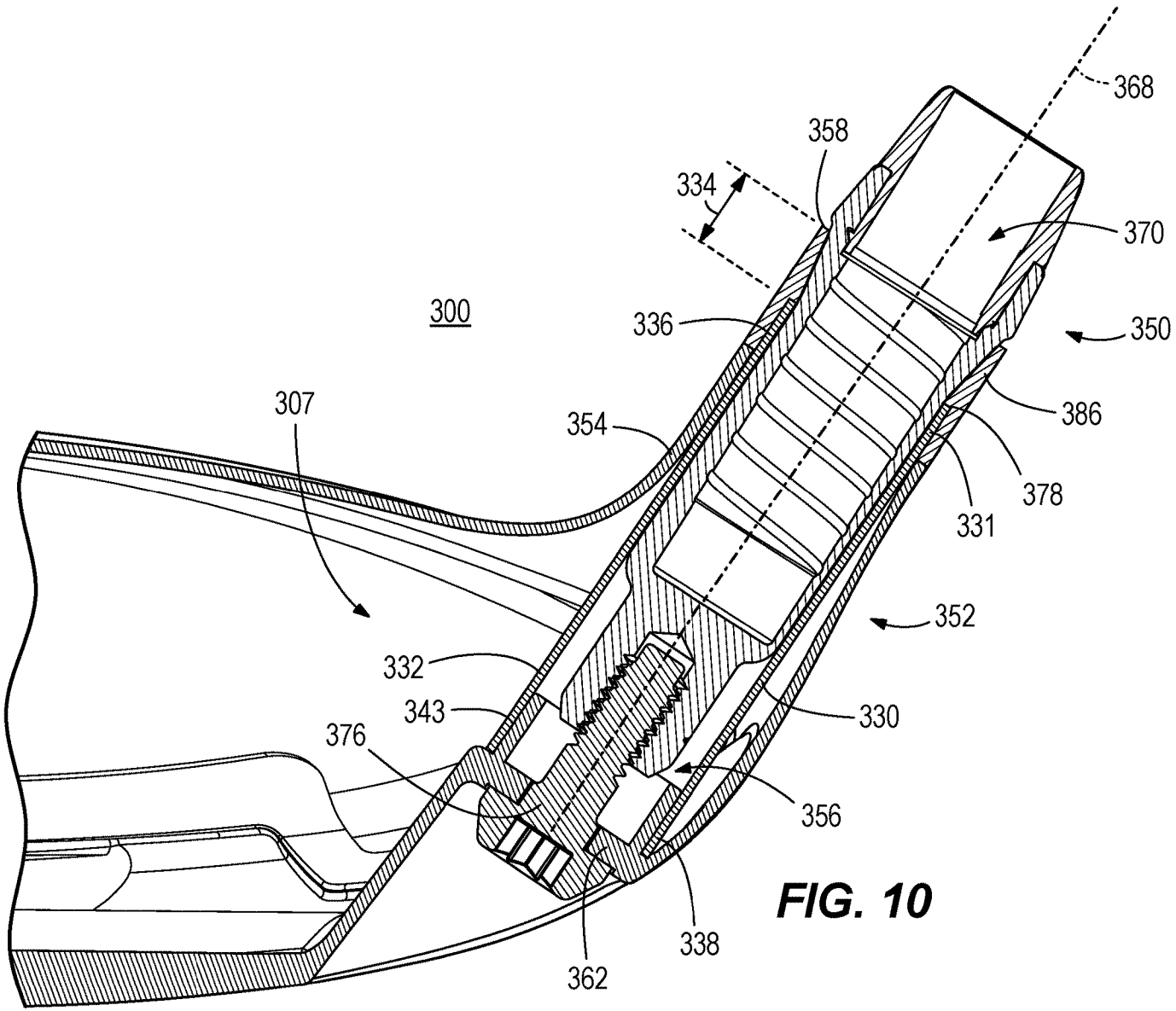
FIG. 10 illustrates a front cross-sectional view of another embodiment of a lightweight shaft-receiving structure comprising a tube insert and a lightweight collar.
Figure 11:
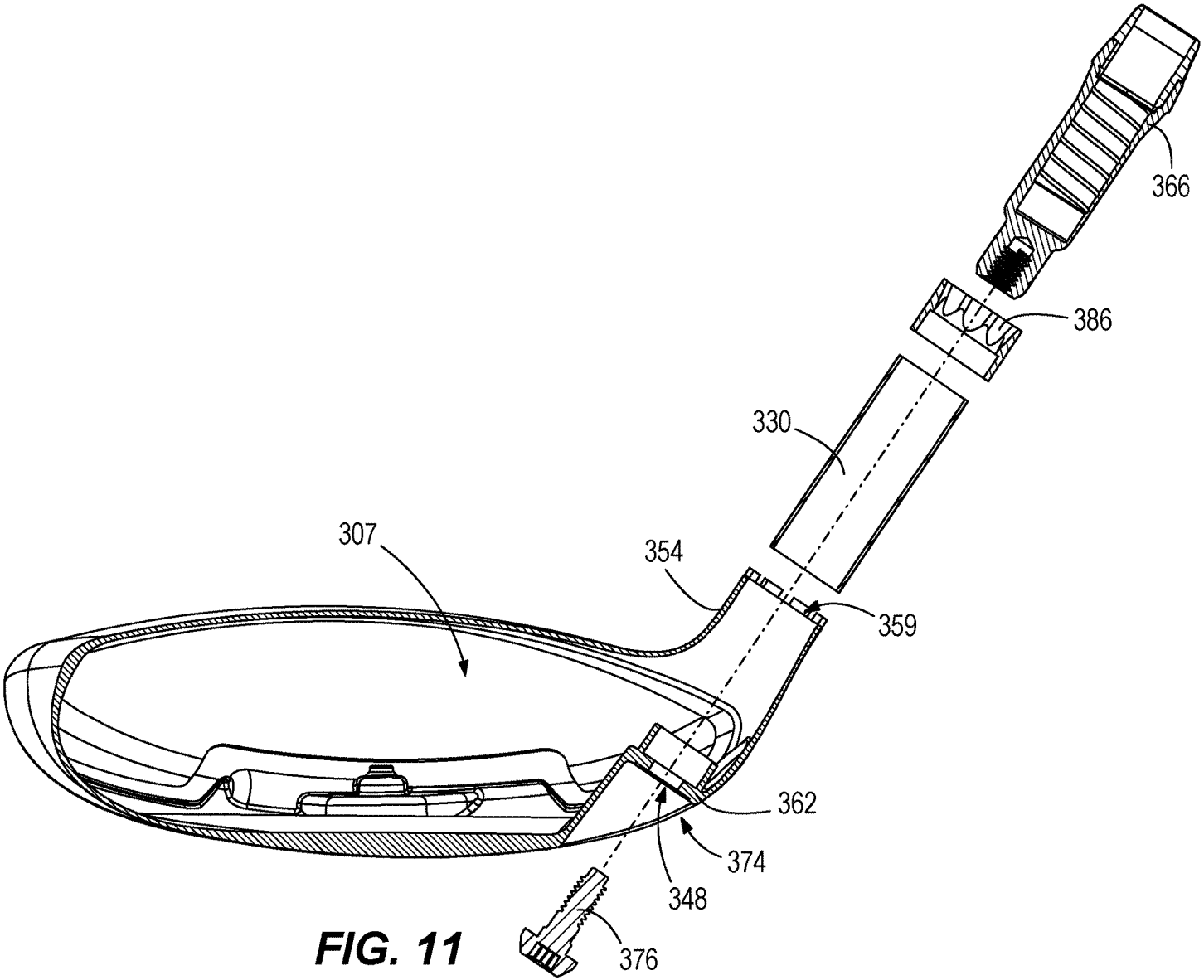
FIG. 11 illustrates an exploded cross-sectional view of the lightweight shaft-receiving structure of FIG. 10.
Figure 12:
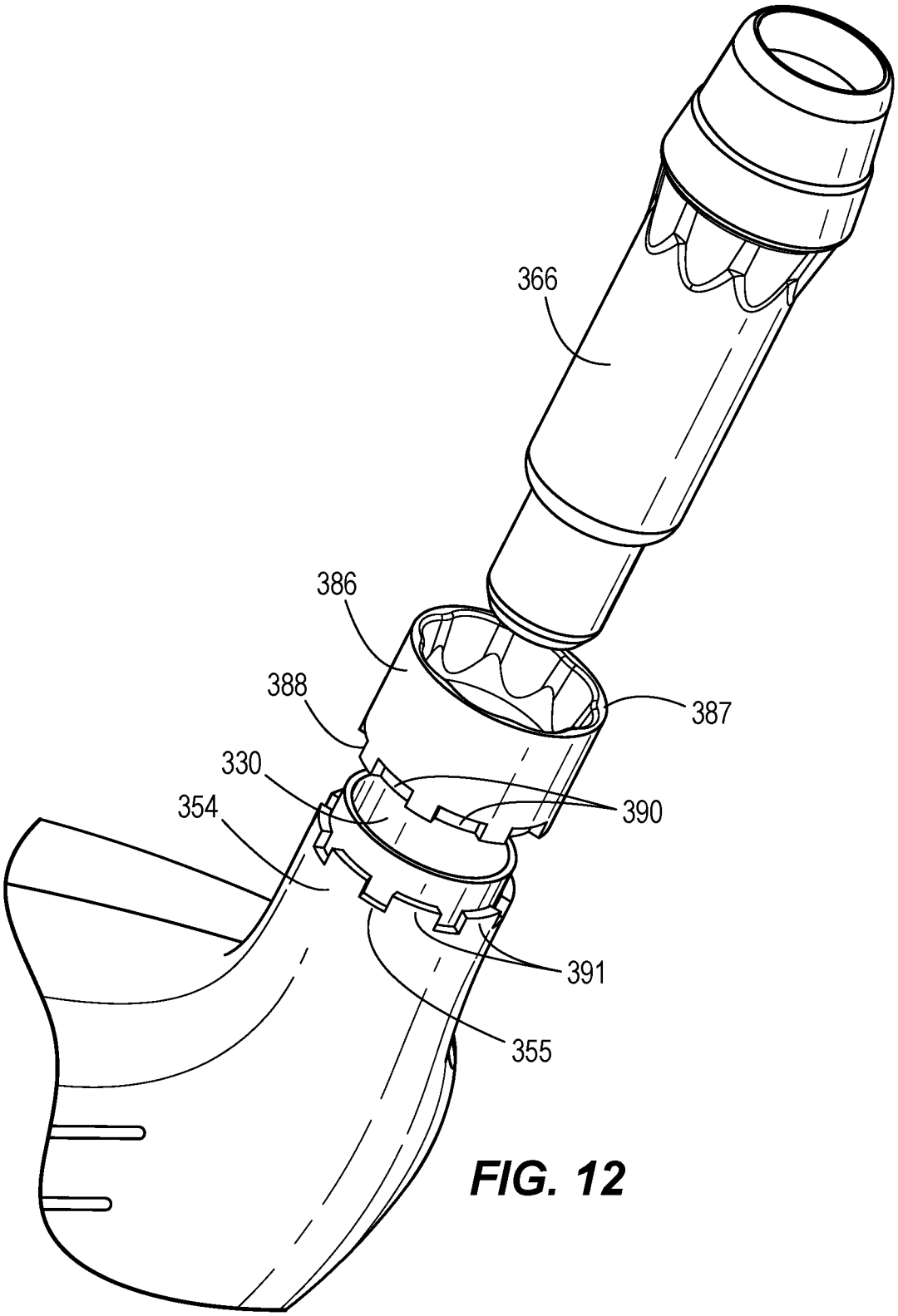
FIG. 12 illustrates a detail exploded view of lightweight shaft-receiving structure of FIG. 10, highlighting connection between the lightweight collar and the hosel.

FIGS. 10-12 illustrate a second embodiment of a club head 300 comprising a lightweight shaft-receiving structure 350 that replaces the hosel tube and portions of the hosel wall 354 (specifically the hosel wall upper portion) with lightweight material. The shaft-receiving structure 350 comprises a tube insert 330 similar to that of the first embodiment 200 that can be inserted from the top rather than through the lower opening 374. Rather than a unitary hosel wherein the entire hosel wall (including the hosel wall upper portion) are integrally formed together as part of the club head body 301, the second embodiment of the shaft-receiving structure 350 comprises a lightweight collar 386 that replaces the hosel wall upper portion and is formed separately from the remainder of the hosel 352. The collar 386 can be coupled to the hosel wall 354 to create a two-piece hosel 352. The collar 386 can be coupled to the top of the hosel wall 354 such that the collar 386 forms the top of the two-piece hosel 352.

The collar 386 is configured to interact with the shaft sleeve 366. The collar 386 forms the hosel bore opening 386. In many embodiments, the collar can form a receiving geometry configured to receive the shaft sleeve 366. For example, in some embodiments, the hosel collar 386 can form one or more lobes configured to receive one or more surface features of the shaft sleeve 366 and provide adjustability to the club head loft angle and/or lie angle. Thus, the collar 386 is configured to receive the shaft sleeve 366 and hold it in place. As illustrated in FIG. 10, the collar 386 forms a lip 378 acting as a lap joint 336 for coupling and/or securing the tube insert 330 within the interior cavity 307. The lip 378 can be located just below the collar 386. When inserted, the top end 331 of the tube insert 330 abuts the lip 378. The tube insert 330 can be inserted from the top of the club head 300, through a hosel wall opening 359 formed by an upper edge 355 of the hosel wall 354 and then covered by the collar 386.

The hosel wall 354 and the collar 386 can be coupled at a juncture formed between the upper edge 355 of the hosel wall 354 and a lower edge 388 of the collar 386. In many embodiments, the hosel wall 354 and the collar 386 comprise mating geometries configured to facilitate coupling the collar 386 to the hosel wall 354 by mechanical interlock and/or adhesion. In some embodiments, as illustrated by FIG. 12, the hosel wall 354 forms a plurality of teeth 391 extending upward from the hosel wall upper edge 355. The collar 386 may comprise a plurality of indentations 390 formed into the collar lower edge 388 that correspondingly mate with the shape of the plurality of teeth 391. The plurality of teeth 391 can be configured to fit within the plurality of indentations 390 to couple the collar 386 to the hosel wall 354. The collar 386 can be secured in place by the use of epoxy or additional mechanical fasteners.

In some embodiments, the collar 386 comprises a lightweight material, as defined above. In many embodiments, the collar 386 is formed of a lightweight metallic material, with a lesser density than that of the metallic body 301. In many embodiments, the collar 386 is provided by a lightweight metal because the collar 386 is located at the upper end of the hosel 352, which typically experiences higher stresses than other portions of the shaft-receiving structure 350. For example, in some embodiments, the collar 386 can be formed of aluminum, an aluminum alloy, titanium, a titanium alloy, magnesium, or a magnesium alloy. In many embodiments, the collar 386 is formed of a metallic material similar to the metallic material of the shaft sleeve 366. both the collar 386 and the shaft sleeve 366 as similar metals prevents galling between any receiving geometries of each respective component.

The shaft receiving-structure 350 comprising the collar 386 further comprises a lightweight tube insert 330 identical or substantially identical to the tube insert 230 described above in relation to club head 200. The top end 331 of the tube insert 330 abuts against the lip 378 formed by the collar 386 and extends downward toward the hosel base 362 and the lower opening 374. Similar to the first embodiment, the tube insert 330 forms the majority of the hosel bore 356 and seals the hosel bore 356 from the rest of the interior cavity 307.

In addition to replacing the mass of the hosel tube with the lightweight tube insert 330, replacing the body material of the hosel wall upper portion with the lightweight collar 386 further reduces the mass of the shaft-receiving structure 350. The replacement of mass via the lightweight tube insert 330 and collar 386 creates discretionary mass to be reallocated throughout the club head 300. In some embodiments, the lightweight shaft-receiving structure 350 including a tube insert 330 and collar 386 can create between 3 and 12 grams of discretionary mass.

Similar to the tube insert 230 described above, tube insert top end 331 of the tube insert 330 can be offset from the topmost edge of the hosel bore opening 358 a tube insert offset distance 334. The tube offset distance 334 can be measured parallel to the hosel bore axis 368. In many embodiments, the tube insert offset distance 334 can be in a range of 0.150 inch to 0.350 inch. In some embodiments, the tube insert offset distance 334 can be between 0.150 and 0.200 inch, between 0.200 and 0.250 inch, between 0.250 and 0.300 inch, or between 0.300 and 0.350 inch. In some embodiments, the tube insert offset distance 334 can be 0.150 inch, 0.160 inch, 0.170 inch, 0.180 inch, 0.190 inch, 0.200 inch, 0.210 inch, 0.220 inch, 0.230 inch, 0.240 inch, 0.250 inch, 0.260 inch, 0.270 inch, 0.280 inch, 0.290 inch, 0.300 inch, 0.310 inch, 0.320, 0.330, 0.340, or 0.350 inch.

As discussed above in reference to FIGS. 17A and 17B, the stresses from a ball impacting the strike face 302 of the golf club head 300 are highest at the impact area near the strike face geometric center 320. As the distance from the impact point increases, the stress borne by the club head material decreases. As the stress is propagated through the material, FIGS. 17A and 17B illustrate that the stress propagates mainly through the outer surface of the golf club head 300, and decreases in the interior cavity 307 of the golf club head 300, as well as toward the rear 311 of the golf club head 301. The tube insert top end 331 is located away from the stress propagation. Likewise, the shaft sleeve 366 attachment point to the threaded fastener 376 at the hosel base 362 is also located away from the stress propagation. Thus, the points of contact between the shaft sleeve 366 and the golf club head 300 are in the lower stress areas. The tube insert 330, by virtue of being located within the interior cavity 307 and away from the exterior surfaces of the club head 300, is protected from high stresses at impact.

In many embodiments, such as the embodiment illustrated in FIGS. 10-12, rather than forming a separate end cap, the hosel base 362 of the second embodiment can be integral with the club head body 301. The hosel base 362 can be cast proximate the lower opening 374 as part of the body 301. The hosel base 362 extends across the lower opening 374, separating the exterior of the club head 300 from the interior cavity 307 near the sole 312. Similar to the end cap 240 of the first embodiment 316, the hosel base 362 forms a platform configured to receive the bottom end 332 of the tube insert 330, holding the tube insert 330 in place. In some embodiments, the hosel base 362 can comprise one or more alignment features configured to center the tube insert 330 in relation to the hosel base 362. In some embodiments, as illustrated in FIG. 10, the hosel base 362 can comprise a protrusion 343 extending upward from the hosel base 362 into the hosel bore 356. The protrusion 343 can be shaped to fit flush against the interior surface of the tube insert 330, aligning the tube insert 330 with the hosel base 362. As illustrated in FIG. 11, the hosel base 362 further comprises an aperture 348 extending into the hosel bore 356. The aperture 348 is configured to receive the fastener 376 that secures the shaft sleeve 366 within the hosel bore 356. In some embodiments, the aperture 348 may be threaded to correspond to a threaded fastener 376. The hosel base 362 seals off the lower opening 374 and holds the tube insert 330 in place in the interior cavity 307. In other embodiments (not shown), the club head 300 comprising a shaft-receiving structure 350 with a collar 386 can be combined with an end cap similar to end cap 240 of club head 200.

The tube insert 330 can be retained in the interior cavity 307 by mechanical and/or adhesive means. In some embodiments, the tube insert 330 is held in place by surrounding structures. As illustrated by FIGS. 10 and 11, the tube insert top end 331 is constrained from above by the lip 378, from an interior direction by the shaft sleeve 366, and from an outer direction by the hosel wall 354 below the lip 378. The tube insert bottom end is constrained from below by the hosel base 362 and from an interior direction by the protrusion 343.

In many embodiments, the tube insert 330 can be held in place by adhesive means. In such embodiments, the shaft-receiving structure 350 can form a plurality of lap joints near the bottom and top ends 332, 331 of the tube insert 330. FIG. 10 illustrates a bottom lap joint 338 formed by the hosel base 362 and a top lap joint 336 formed in combination by at least a portion of the hosel wall 354 and at least a portion of the collar 386. The tube insert 330 and the club head 300 can be epoxied together at both the top lap joint and bottom lap joint such that the hosel insert remains secured in place, even when the fastener is loosened and the shaft sleeve is removed.

As alluded to above, providing a hosel 352 with a separate collar 386 to replace an upper portion of the hosel wall can allow for greater mass reduction of the shaft receiving structure 350, because the collar 386 can be formed of a lighter material than the hosel 350. The inclusion of the lightweight tube insert 330 and lightweight collar 386 reduces the mass of the shaft-receiving structure 350 in comparison to a prior-art shaft-receiving structure formed from the body material. In some embodiments, the inclusion of the lightweight tube insert 330 and collar 386 to replace denser material reduces the mass of the shaft receiving structure 350 by between 3 grams and 12 grams. The mass reduction of the shaft-receiving structure 350 frees up discretionary mass that can be allocated throughout the club head 300 to improve mass properties and performance.

V. Lightweight Shaft-Receiving Structure with Hosel Insert

Figure 13:
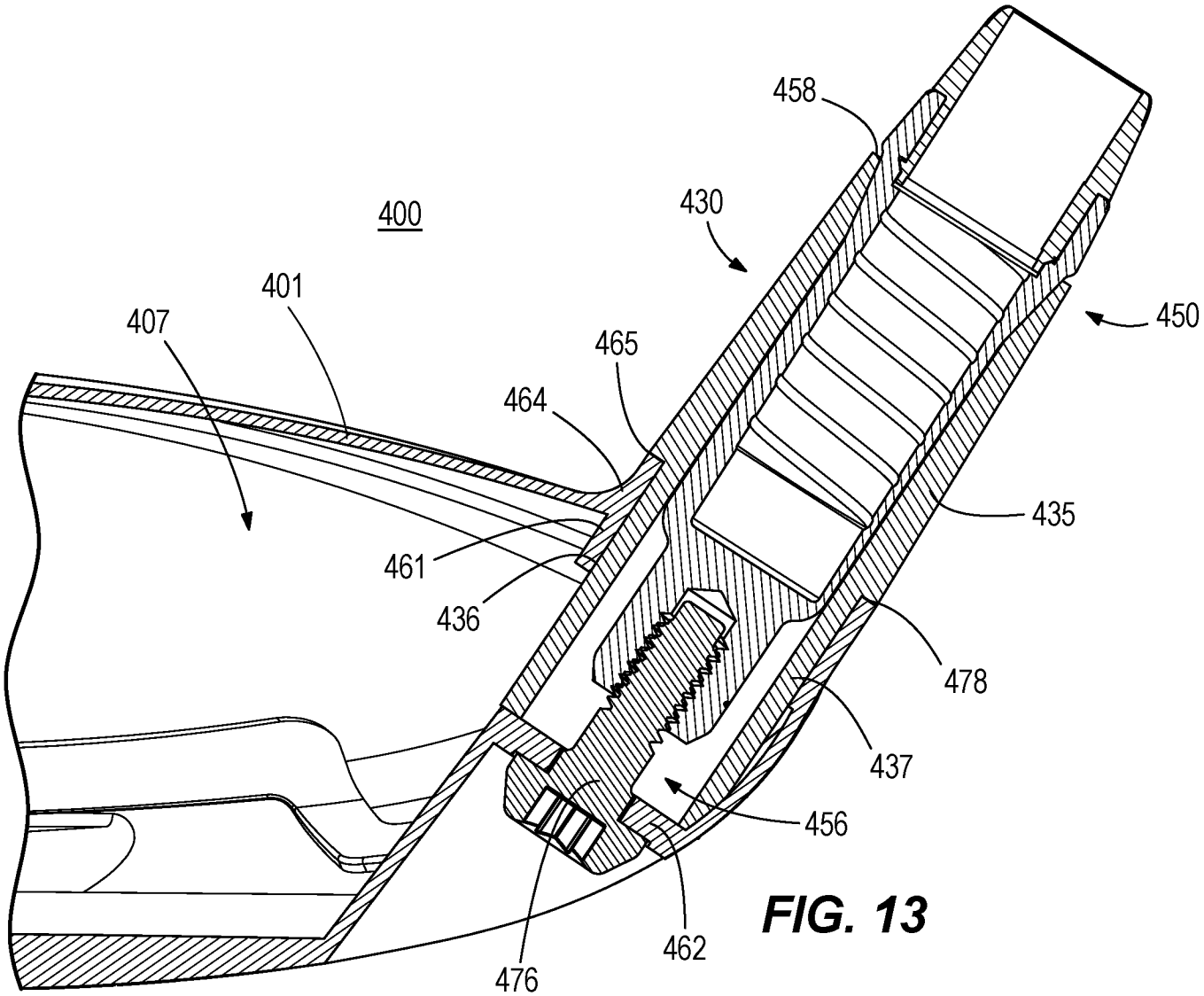
FIG. 13 illustrates a front cross-sectional view of another embodiment of a lightweight shaft-receiving structure comprising a hosel insert.
Figure 14:
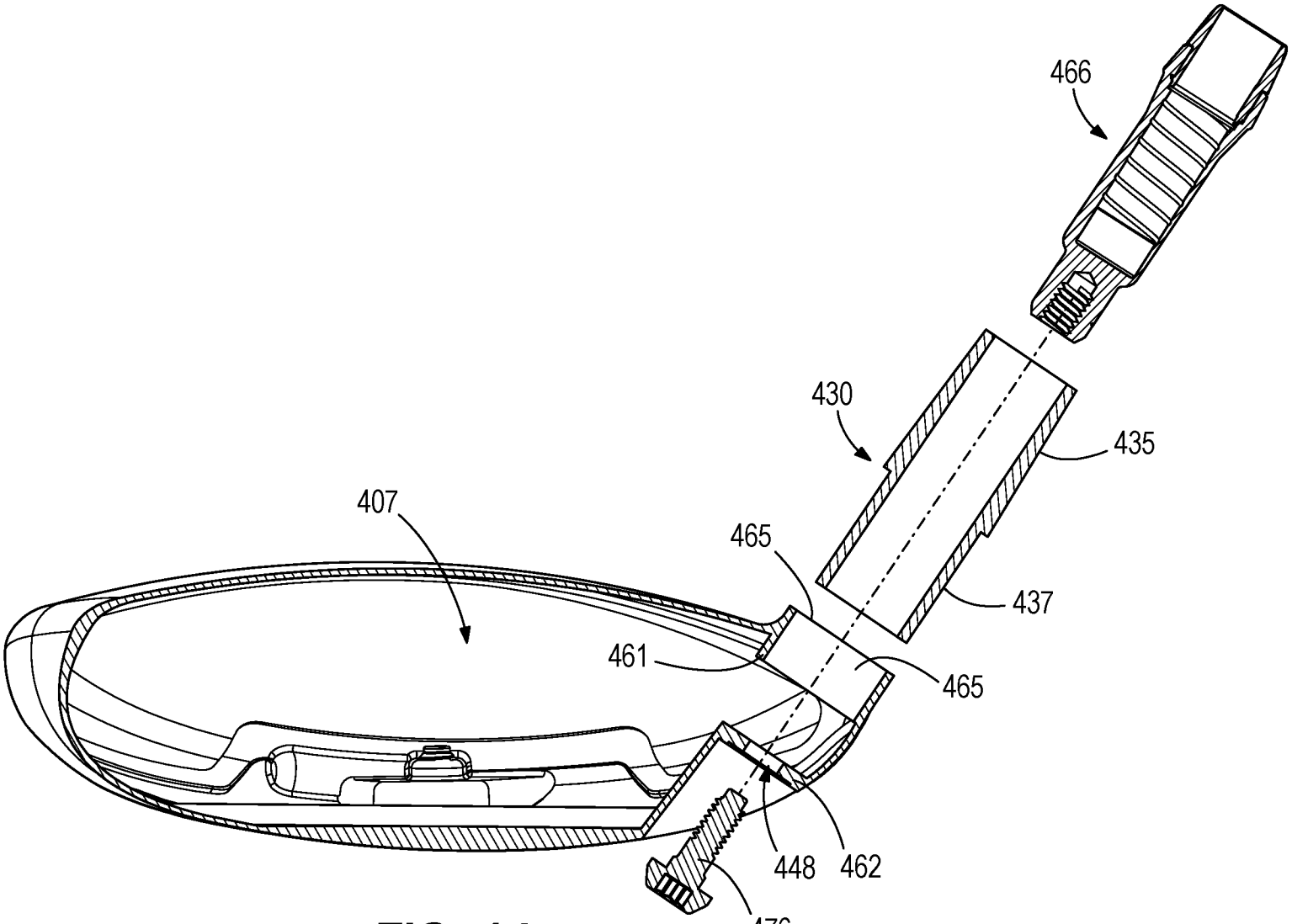
FIG. 14 illustrates an exploded cross-sectional view of the lightweight shaft-receiving structure of FIG. 13.

FIGS. 13 and 14 illustrate another embodiment golf club head 400 of a lightweight shaft-receiving structure 450 comprising a lightweight hosel insert 430 that forms the entirety of the hosel tube and the hosel wall 454. The shaft-receiving structure 450 comprises a hosel insert 430 of a lightweight material (as defined above). As illustrated in FIG. 13, the body 401 forms a hosel transition 464 connecting the crown 410 to the hosel wall 454, but does not form any of the hosel wall 454 past the hosel transition 465. Instead, the body 401 forms a hosel transition opening 465 at the top end of the hosel transition 464. The hosel insert 430 can be inserted into the hosel transition opening 465 and coupled to the hosel transition 464. The hosel insert 430 forms a wall portion 435 located outside of the interior cavity 407 and visible from the exterior of the club head 400 and an interior tube portion 437 that extends into the interior cavity 407 and seals off the hosel bore 456 from the remainder of the interior cavity 407. The wall portion 435 extends upward from the hosel transition 464. As such, the inner surface of the wall portion 435 defines an upper portion of the hosel bore 456. The wall portion 435 forms the entirety of the hosel wall, including the hosel bore opening 458. As such, the wall portion 435 is configured to receive the shaft sleeve 466 through the hosel bore opening 458. The wall portion 435 can also form any receiving geometries configured to receive the shaft sleeve 466. Any such geometries can be formed into the interior surface of the wall portion 435.

The hosel insert 430 further comprises a tube portion 437 extending downward from the bottom of the wall portion 435 through the hosel transition opening 465 and toward the hosel base 462. An inner surface of the tube portion 437 forms the lower portion of the hosel bore 456. The tube portion 437 seals off the hosel bore 456 and the exterior of the club head 400 from the interior cavity 407, preventing debris, particulate, and water from entering the interior cavity 407 through the hosel bore 456 opening.

The hosel insert 430 is a generally tubular, hollow member that forms an outer diameter and an inner diameter defined by the outer surface and the inner surface, respectively. The outer diameter of the hosel insert 430 can vary along different portions of the hosel insert 430. As illustrated in FIG. 13, the outer diameter of the wall portion 435 is substantially larger than the outer diameter of the tube portion 437. The diameter of the hosel insert 430 changes abruptly at the hosel transition opening 465, distinctly defining where the wall portion 435 ends and the tube portion 437 begins. The abrupt change in diameter creates a ledge 478 separating the wall portion 435 and the tube portion 437. The ledge 478 abuts the upper edge of the hosel transition 464. The outer diameter of the wall portion 435 at the hosel transition opening 465 can match the diameter of the hosel transition opening 465 at the upper edge. As such, the hosel transition 464 and the wall portion 435 create a smooth, continuous surface therebetween, resembling a unitary, integrally formed hosel. The outer diameter of the tube portion 437, which is a lesser diameter than the hosel transition 464, is sized with the capability of extending through the hosel transition opening 465 and into the interior cavity. The relatively large outer diameter of the wall portion 435 and the relatively small outer diameter of the tube portion 437 allow the hosel insert 430 to replace the greatest possible amount of mass with a lightweight material. Internally, the hosel insert 430 replaces the mass of the hosel tube, and externally, the hosel insert 430 replaces the hosel wall 454 with a lightweight material to create discretionary mass.

In some embodiments, the hosel transition 464 can further comprise a bonding wall 461 in the interior cavity 407, configured to center the tube portion 437 and provide a surface for the hosel insert 430 to bond to. The bonding wall 461 can be a cylindrical wall that is integrally formed with the hosel transition 464. The bonding wall 461 extends from the hosel transition opening 465 at least partially toward the hosel base 462. The bonding wall 461 comprises an inner diameter corresponding to the outer diameter of the tube portion 437. The tube portion 437 of the hosel insert 430 fits flush against and adheres to the bonding wall 461. The bonding wall 461 therefore serves as a lap joint that can secure and center the hosel insert 430 within the interior cavity 407.

The club head 400 of the third embodiment further forms a hosel base 462 creating a floor for the hosel insert 430, wherein a bottom end of the hosel tube portion 437 is configured to abut the hosel base 462. The bottom end of the hosel insert 430 (i.e. the bottom end of the hosel tube portion 437) can rest against the hosel base 462. The hosel base 462 of the third embodiment may be substantially similar to the integrally formed hosel base 462 of the second embodiment. The hosel base 462 can be integrally cast with the club head body 401 and close off the lower opening 474, separating the exterior of the club head from the interior cavity 407 near the sole. As illustrated in FIG. 14, the hosel base 462 can comprise an aperture 448 to provide passage for a fastener 476 into the hosel bore 456 to couple to the shaft sleeve 466. In some embodiments, the hosel base 462 can comprise one or more alignment features configured to center the hosel insert 430 in relation to the hosel base 462. In some embodiments (not shown), the club head 400 comprising a shaft-receiving structure 450 with a hosel insert 430 can be combined with an end cap similar to end cap 240 of club head 200.

The hosel insert 430 can be retained within the shaft-receiving structure 450 by mechanical and/or adhesive means. In many embodiments, the hosel insert 430 is held in place by a tensive force created by the fastener 476, the shaft sleeve 466, and the hosel base 462. As illustrated by FIG. 14, the fastener 476 extends through the lower opening 474 and couples to the bottom end of the shaft sleeve 466. Because the shaft sleeve 466 is inserted through the hosel bore opening 458 and the fastener 476 is inserted through the aperture 448 of the hosel base 462, the fastener 476 and shaft sleeve 466 create opposing forces holding the hosel insert 430 in compression. Specifically, the fastener 476 holds the shaft sleeve 466 down against the hosel insert 430, which in turn presses downward on the hosel base 462. The tensive force created between the fastener 476 and the shaft sleeve 466 holds the hosel insert 430 in place within the interior cavity 407.

In many other embodiments, the hosel insert 430 can be held in place by adhesive means. In such embodiments, the shaft-receiving structure 450 can form a plurality of lap joints configured to couple the hosel insert 430 to the club head body 401 via the use of an adhesive or epoxy. FIG. 13 illustrates a lap joint 436 formed between the tube portion 437 and the bonding wall 461. The hosel insert 430 and the club head 400 can be epoxied or otherwise adhesively bonded together at the lap joint 436 such that the hosel insert 430 remains secured in place, even when the fastener 476 is loosened and the shaft sleeve 466 is removed.

The inclusion of the lightweight hosel insert 430 reduces the mass of the shaft-receiving structure 450 in comparison to a similar structure formed from entirely from body material. In some embodiments, the inclusion of the lightweight hosel insert 430 replacing denser material reduces the mass of the shaft receiving structure 450 by between 3 grams and 12 grams. The mass reduction of the shaft-receiving structure 450 frees up discretionary mass that can be allocated throughout the club head 400 to improve mass properties and performance.

Because the hosel insert 430 forms exterior portions of the hosel 452 and extends all the way up to the hosel bore opening 458, the hosel insert 430 may experience greater stresses at impact than the hosel tubes 230, 330 of previous embodiments, as such, it may be advantageous to provide the hosel insert 430 with a material comprising a higher strength than a composite material. In many embodiments, the hosel insert 430 can be constructed of a lightweight metal material, rather than a non-metal material. In some embodiments, the hosel insert 430 can be formed of aluminum, an aluminum alloy, or any lightweight metal material with a lower density than the body material. The hosel insert 430 being provided of a lightweight metal allows the mass of the shaft-receiving structure 450 to be reduced (by virtue of the lightweight metal comprising a lesser density than the body material) which still retaining the structural integrity of the club head 400.

VI. Tube-Less Lightweight Shaft-Receiving Structure

Figure 15:
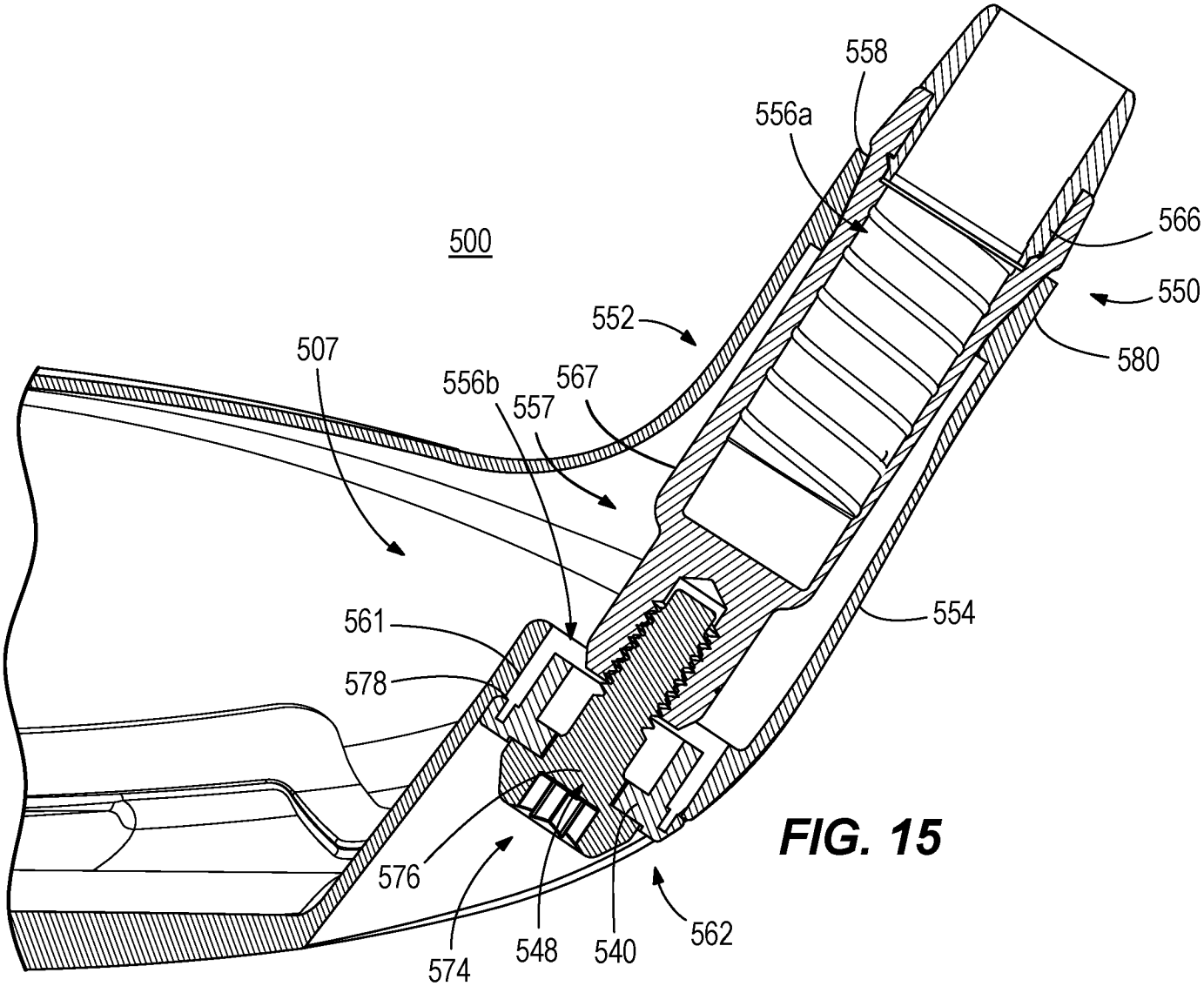
FIG. 15 illustrates a front cross-sectional view of another embodiment of a lightweight shaft-receiving structure devoid of a tube insert.

FIG. 15 illustrates another embodiment of a lightweight shaft-receiving structure 550 devoid of a tube insert (hereafter referred to as a "tube-less" shaft-receiving structure 500). In the embodiment illustrated in FIG. 15, the hosel tube of prior art designs is eliminated entirely. As such, the shaft sleeve 566 is not concealed within a tube portion or tube insert. Therefore, at least a portion of the shaft sleeve 566 is exposed to the interior cavity 507. In many embodiments, at least a portion of the shaft sleeve outer wall 567 is exposed to the interior cavity 507. The tube-less shaft-receiving structure 550 can comprise a mass reduced by 3 to 12 grams in comparison to a similar shaft-receiving structure formed entirely of body material and comprising a hosel tube. The tube-less shaft-receiving structure 550 can further comprise one or more lightweight components to form other portions of the club head 500 traditionally formed by body material in the prior art, such as the hosel base 562. Reducing the mass of the shaft-receiving structure 550 by eliminating the hosel tube and forming other components out of lightweight material rather than body material frees up discretionary mass to be re-allocated to other areas of the club head 500 to improve mass properties and performance.

The tube-less shaft-receiving structure 550 can be substantially similar to the shaft-receiving structure 250 illustrated in FIGS. 7-9, but for the tube-less shaft-receiving structure 500 being devoid of a tube insert (such as tube inserts 230 and 330 of previous embodiments). The tube-less shaft receiving structure 550 comprises a hosel 552 and a shaft sleeve 566. The hosel 552 forms the hosel wall 554, wherein the hosel wall upper portion 580 forms a hosel bore opening 558 configured to receive the shaft sleeve 566.

The shaft-receiving structure 550 further comprises an end cap 540 forming a hosel base 562. The end cap 540 can be formed as a separate component from the club head body 101. The end cap 540 is provided to form the hosel base 562 with a lightweight material, rather than forming a hosel base out of body material, as is common in the prior art. In many embodiments, the end cap 540 can be substantially similar to end cap 240. The end cap 540 can be configured to close off the lower opening 574.

As illustrated in FIG. 15, the shaft-receiving structure 550 further comprises a base wall 561 extending from the lower opening 574 into the interior cavity 507. The bottom of the hosel base wall 561 can form a ledge 578, wherein the end cap 540 is configured to abut the ledge 578. The end cap 540 can be shaped to cover the entire lower opening 574, separating the exterior of the club head 500 from the interior cavity 507.

Due to the lack of a tube insert or hosel tube, the tube-less shaft-receiving structure 550 does not comprise a continuous hosel bore. In other words, tube-less shaft receiving structure 550 does not comprise a hosel bore extending all the way from the hosel bore opening 558 to the hosel base 562. As illustrated in FIG. 15, the shaft receiving structure 550 comprises an upper hosel bore 556*a* and a lower hosel bore 556*b* separate from the upper hosel bore 556*a*. The upper hosel bore 556*a* can be formed by the interior surface of the hosel wall upper portion 580. In many embodiments, the upper hosel bore 556*a* can extend from the hosel bore opening 558, which is formed by the upper edge of the hosel wall upper portion 580, to the bottom of the hosel wall upper portion 580. In other embodiments, a portion of the upper hosel bore 556*a* can be formed by the hosel wall 554. The upper hosel bore 556*a* can transition, either abruptly or gradually, into the interior cavity 507. The upper hosel bore 556*a* transitions into the interior cavity 507 as the hosel wall 554 diverges from the shaft sleeve 566. The lower hosel bore 556*b* can be formed by an interior surface of the hosel base wall 561. The lower hosel bore 556*b* extends from the lower opening 574 to the top of the hosel base wall 561. Similar to the upper hosel bore 556*a*, the lower hosel bore 556*b* feeds directly into the interior cavity 507.

There is no structure connecting the upper hosel bore 556*a* to the lower hosel bore 556*b*. The upper hosel bore 556*a* and the lower hosel bore 556*b* each individually feed into the interior cavity 507. The upper hosel bore 556*a* and the lower hosel bore 556*b* do not feed into one another. The shaft sleeve 566 extends through a gap 557 formed between the upper hosel bore 556*a* and the lower hosel bore 556*b*, wherein the shaft sleeve 566 is thereby exposed to the interior cavity 507.

The tube-less shaft-receiving structure 550 can be held together by the fastener 576, the shaft sleeve 566, and the end cap 540. The shaft sleeve 566 is inserted into the upper hosel bore 556*a* through the hosel bore opening 558 and is configured to abut against the hosel wall upper portion 580. The fastener 576 is inserted into the lower hosel bore 556*b* through an aperture 548 formed in the end cap 540 and is configured to abut an exterior surface of the end cap 540. When tightened, the fastener 576 presses against the exterior surface of the end cap 540 to hold the shaft sleeve 566 in tension. The fastener 576 and shaft sleeve 566, when securely coupled together, create opposing forces holding the components of the shaft-receiving structure 550 together. The fastener 576 creates an upward force pushing against the end cap 540, while the shaft sleeve 566 creates an opposing downward force against the interior surface of the hosel wall upper portion 580. As such, the shaft sleeve 566 is retained within the upper hosel bore 556*a* by the tensive force pulling downward on the shaft sleeve 566. The tensive force created between the fastener 576 and the shaft sleeve 566 holds the components of the shaft-receiving structure 550 in place.

The tube-less shaft-receiving structure 550 provides a maximum amount of discretionary mass to be redistributed about the club head 500. The tube-less shaft receiving structure 550 comprises minimal structure due to the complete elimination of the hosel tube. Further, the tube-less shaft-receiving structure 550 does not reintroduce any mass, however negligible, through the inclusion of any separate tube inserts. The tube-less shaft-receiving structure 550 can be advantageous to include in club heads 500 wherein maximum discretionary mass is desired over the ability to seal the interior cavity 507.

VII. Lightweight Shaft-Receiving Structure with External Hosel Insert

Figure 16:
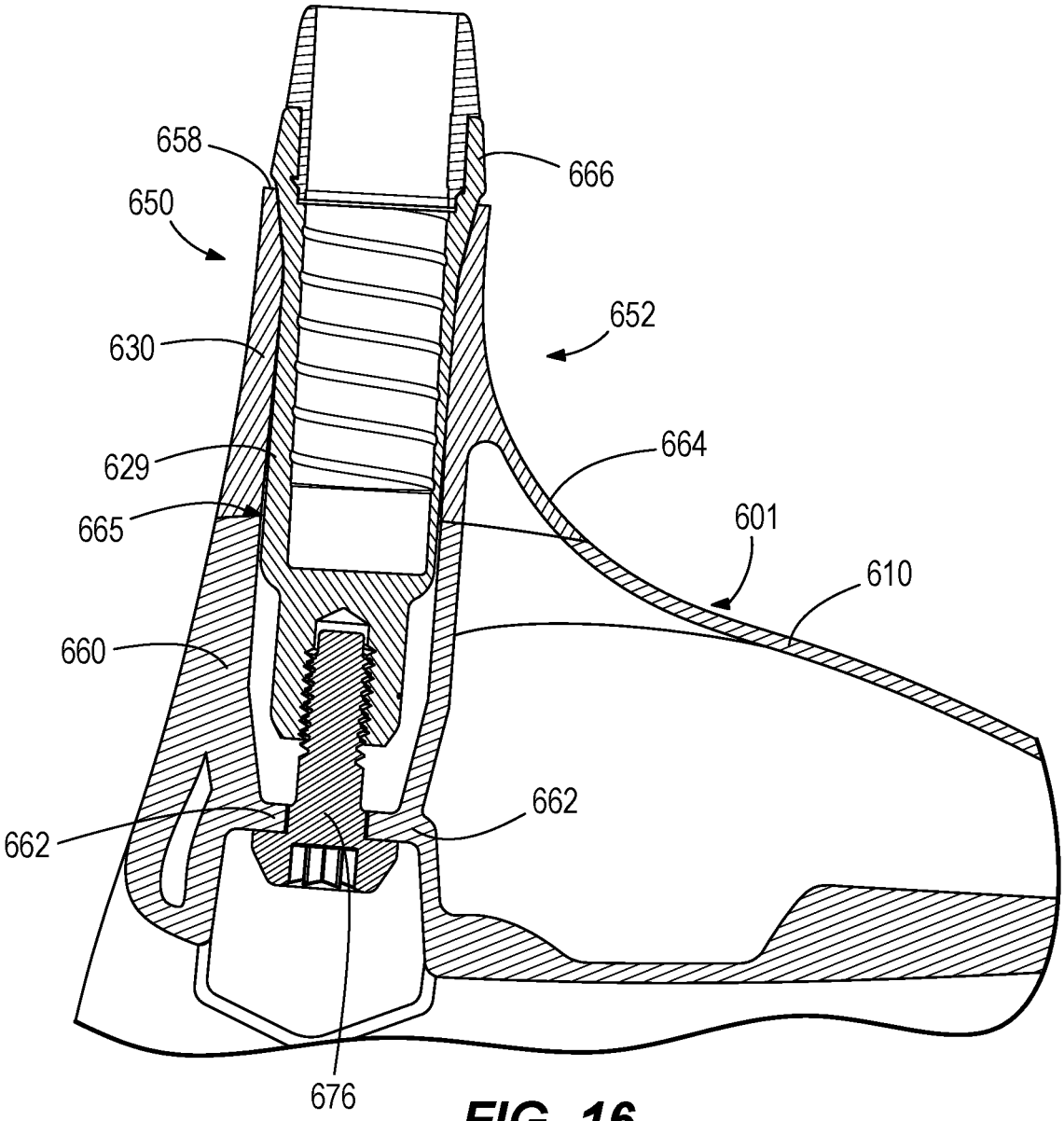
FIG. 16 illustrates a heel-side cross-sectional view of another embodiment of a lightweight shaft-receiving structure comprising an external hosel insert.

FIG. 16 illustrates another embodiment of a lightweight shaft-receiving structure 650 that replaces portions of the hosel wall 654 and forms a portion of a hosel transition 664 with a hosel insert 630 constructed of a lightweight material (as defined above). In many embodiments, the hosel wall 654 and hosel transition 664 can be formed together as a singular insert 630 configured to couple to the club head body 601 at the crown 610. In such embodiments, the club head 600 can form a hosel transition opening 665 near the heel side of the crown 610. The hosel insert 630 can be configured to couple to the club head body 601 at the perimeter of the hosel transition opening 665. In many embodiments, the hosel insert 630 can be attached to the club head body 601 at the hosel transition opening 665 by mechanical means and/or adhesive means. In some embodiments, the hosel insert 630 can comprise a mating geometry at the hosel transition 664 configured to couple to a corresponding mating geometry formed at the perimeter of the hosel transition opening 665. The hosel insert 630 forms the hosel bore opening 658 and may include any receiving geometry configured to couple the shaft sleeve 666 within the hosel bore 656. For example, in some embodiments, the hosel insert 630 can form one or more lobes configured to receive one or more surface features of the shaft sleeve 666 and provide adjustability to the club head loft angle and/or lie angle.

The hosel insert 630 comprises an inner surface with an inner diameter that defines at least an upper portion of the hosel bore 656. In many embodiments, the inner surface of the hosel 652 defines a portion of the hosel bore 656 extending from the hosel bore opening 658 to the hosel transition opening 665. In many embodiments, as illustrated by FIG. 16, the lightweight hosel insert 630 is only externally located and does not extend through the hosel transition opening 665 or into any portion of the interior cavity 607. The internal portions of the shaft-receiving structure 650 (i.e. the tube portion 660, the hosel base 662, etc.) can be integrally cast with the rest of the club head body 601. As such, the tube portion 660, which is separate from the lightweight hosel insert 630, forms the lower portion of the hosel bore 656, extending from the hosel transition opening 665 to the hosel base 662. Since the tube portion 660 and hosel base are formed of high-strength body material, the shaft-receiving structure 650 is equipped to handle any stresses occurring proximate the sole 612.

In some embodiments, rather than being formed as a separate insert and attached to the crown via mechanical or adhesive means, a lightweight hosel and hosel transition 664 can be integrally formed with a portion of the club head body 601. This configuration is applicable to a club head comprising a multi-material construction with a lightweight non-metal component forming a majority of the crown 610, such as a crown insert made from a composite material. The lightweight hosel insert 630 and hosel transition 664 can serve as an extension of the crown 610, extending upward from the crown 610 at the heel end and forming the hosel transition 664 and hosel wall 654. In such embodiments, due to the integral formation of the hosel wall 654 and hosel transition 664 with the composite crown 610, the material of the hosel wall 654 and hosel transition 664 can be the same as the material of the composite crown 610. The integral hosel wall 654 and hosel transition 664 can be formed in combination with any variation of the composite crown described in detail above, such as a composite crown 610 that wraps around the skirt 614 and forms a portion of the sole 612 on the heel 604 and/or toe 606.

Replacing the hosel wall 654 and hosel transition 664 with a lightweight material, whether formed integrally with the composite crown 610 of a multi-material club head, or as a separate insert coupled at the hosel transition opening 665, reduces the mass of the shaft-receiving structure 650 in comparison to a similar structure formed entirely of body material. In some embodiments, replacing the hosel wall 654 and forming a hosel transition 664 with a lightweight material by including the hosel insert 630 reduces the mass of the shaft-receiving structure 650 by between 3 grams and 12 grams. The mass reduction of the shaft-receiving structure 650 frees up discretionary mass that can be allocated throughout the club head 600 to improve mass properties and performance.

EXAMPLES

Example 1: Golf Club Head Stress Distribution in a Lightweight Shaft-Receiving Structure As discussed above, the prior art shaft receiving structure comprises portions, such as the hosel tube 160, that, surprisingly, do not significantly contribute to the structural integrity of the golf club head. After the analysis showing this low stress on the hosel tube 160 was done, experiments were conducted to determine if the hosel tube could simply be removed, or replaced with lighter materials, in order to provide discretionary mass.

FIGS. 17A and 17B illustrate peak stresses during the golf club head impact with a golf ball. FIG. 17A illustrates peak stresses on a prior-art golf club head 100 having a hosel tube 160 comprising the same material as the golf club head main body 101. The finite element analysis illustrated in FIG. 17A demonstrates that the hosel tube 160 experiences negligible stress at impact. Negligible stress is defined as stress less than 50% of material failure loading. This means that the hosel tube 160 is not bearing any significant structural load. It was unexpected that the hosel tube 160 had such low stress upon impact and was not significantly contributing to the structural integrity of the club head 100.

To expand upon the analysis illustrated in FIG. 17A, an otherwise identical club head 100 with the hosel tube 160 removed was modeled. FIG. 17B illustrates the peak stresses on the golf club head 100 without the hosel tube 160, thereby exposing the shaft sleeve 166 to the interior cavity interior 107. The analysis of the golf club head without hosel tube 160 showed that the altered shaft support structure still bears a very low level of stress at impact.

At the peak stress during impact, the strike face 102, the crown return portion 122, and the sole 112 proximate to the leading edge 103 absorb the force impact and are highly stressed. These areas require the high-strength body material to avoid impact induced failure. In contrast, the hosel tube 160 illustrated in FIG. 17A bears little of the impact forces during the ball impact. As discussed above, this allows the hosel tube to be entirely removed, or replaced with a material that is both less dense and that has lesser material strength. As illustrated in FIG. 17B, the hosel tube 160 can be removed, and the exposed shaft sleeve 166 bears little stress from the impact. This illustrates that the hosel tube 160 is unnecessary in regards to the durability of the golf club head when impacting a golf ball.

The portion of the golf club head 100 proximate to the hosel 152 and within the interior cavity 107 of the club head 100 is a lower stress portion at impact compared to the strike face 102, crown return 122, and sole 112 proximate the leading edge 103 of the golf club head 100. Other lower stress zones are located further from the strike face 102. The lower stress portion of the club head 100 proximate the hosel 152 and within the interior 107 of the golf club head can be replaced without compromising the club head durability at impact. As described above, a significant portion of the impact force experienced by the shaft-receiving structure 150 occurs proximate upper contact plane 186 and lower contact plane 187 (illustrated in FIGS. 18A and 18B). The further away from the upper contact plane 186 and lower contact plane 187, the less stress the shaft-receiving structure 150 experiences and less mass is required to structurally support the club head 100. Mass can be reduced from portions of the shaft-receiving structure 150 distanced away from the upper contact plane 186 and the lower contact plane 187. In many embodiments, mass can be reduced from portions of the shaft-receiving structure characterized by a certain distance away from the hosel bore opening 156, described below in relation to a tube insert offset distance.

The analysis illustrated in FIGS. 17A and 17B demonstrates that from a durability standpoint, the hosel tube 160 can be formed of any lightweight material or even removed entirely. To maximize discretionary mass, it is desirable to provide a hosel tube made of the lightest possible material or remove it entirely, depending on the desired functionality. For example, in some embodiments, it may be desirable to retain a lightweight hosel tube in the form of a tube insert (such as tube insert 230 and 330) for non-load-bearing purposes, such as sealing the interior cavity 107 from the hosel bore 156 or holding the shaft sleeve 166 in place. In other embodiments, the non-load-bearing functionality of the hosel tube 160 may not be desired, and the hosel tube 160 may be removed completely. Such is the case in shaft-receiving structure 550 detailed above. Examples of such club head are discussed below.

Example 2: Mass Properties of Club Head Comprising a Lightweight Shaft-Receiving Structure The mass properties were compared between a plurality of exemplary club heads with lightweight shaft-receiving structures and a control club head. The MOI values of each club head were compared. Further, the amount of discretionary mass created by the inclusion of the lightweight shaft-receiving structure in each exemplary club head was compared, with the control club head as a baseline. Each club head was similarly constructed, but for the differences in the shaft-receiving structures.

The first exemplary club head was a fairway wood-type club head comprising a lightweight shaft-receiving structure similar to shaft-receiving structure 250. The first exemplary club head comprised a lightweight tube insert forming a hosel tube and a lightweight lower end cap forming a hosel base. The tube insert was inserted through the lower opening into the interior cavity. The end cap covered the lower opening and enclosed the tube insert within the interior cavity.

The second exemplary club head was a fairway wood-type club head comprising a lightweight shaft-receiving structure similar to shaft-receiving structure 550. The second exemplary club head comprised a tube-less design. The second exemplary embodiment was devoid of a tube insert. The club head comprised an upper hosel bore formed by an interior surface of the hosel wall upper portion and a lower hosel bore formed by an interior surface of a hosel base wall. The upper hosel bore and the lower hosel bore were not connected and both fed into the interior cavity. As such, when the shaft sleeve was inserted, the shaft sleeve outer wall was exposed to the interior cavity. The second exemplary club head comprised a lightweight end cap forming a hosel base and covering the lower opening.

The control club head was a prior art fairway wood-type club head comprising a prior-art shaft receiving structure similar to shaft-receiving structure 150. The control club head comprised a hosel, a hosel tube, and a hosel base each formed integrally with the club head body and formed out of body material. The control club head shaft-receiving structure did not comprise any lightweight components.

Table 1 below displays the CG positions of each exemplary club head and the control club head. The values for discretionary mass represent how much mass is saved by the inclusion of the lightweight shaft-receiving structure in each exemplary club head, relative to the control club head.

TABLE 1

| Club Head | Discretionary Mass (g) | CGy (in.) | CGz (in.) |
|---|---|---|---|
| Control | — | −0.120 | 1.178 |
| Exemplary 1 | 4.5 | −0.151 | 1.189 |
| Exemplary 2 | 5.5 | −0.156 | 1.193 |

As evidenced by Table 1, the exemplary club heads exhibited discretionary mass gains, wherein the discretionary mass was redistributed about the club head to improve mass properties. Specifically, in the present example, the discretionary mass was redistributed to improve the CG position, prioritizing a lower CG position to provide higher launch, less spin, and more ball speed. The discretionary mass was reintroduced to the club head by adding mass to a mass pad on the sole. In other words, portions of the sole mass pad were thickened in the exemplary club heads to produce a lower CG position. As such, the control club head and both of the exemplary club heads comprised the same overall mass, but with the exemplary club heads comprising a more advantageous mass distribution for CG placement purposes.

Exemplary club head 1 exhibited an increase in discretionary mass of 4.5 grams relative to the control club head, leading to a lowering of the CG height (CGy) by 0.031 inch and an increase in CG depth (CGz) of 0.011 inch. The lower CG depth of the first exemplary club head can provide increased performance, such as a higher launch, less spin, and more ball speed. The increase in CG depth can help increase and/or retain MOI.

Exemplary club head 2 exhibited an increase in discretionary mass of 5.5 grams relative to the control club head, leading to a lowering of the CG height (CGy) by 0.036 inch and an increase in CG depth (CGz) of 0.015 inch. The lower CG depth of the secondary exemplary club head can provide increased performance, such as a higher launch, less spin, and more ball speed. The increase in CG depth can help increase and/or retain MOI.

The comparison illustrates the benefits of providing a lightweight shaft-receiving structure. The lightweight shaft-receiving structures created between 4.5 and 5.5 grams of discretionary mass relative to the control club head, leading to improvements in the club head CG position to influence performance characteristics. As discussed above, the creation of discretionary mass and improvements in CG position come without any sacrifice to the structural integrity of the club head, as the lightweight components of the lightweight shaft-receiving structures described herein are not critical to bearing stress load.

Example 3: Ball Flight Performance of Club Head with Lightweight Shaft-Receiving Structure The ball flight performance of an exemplary club head was compared to a control club head. The ball speed, launch angle, and spin rate were measured for each club head in a field test and compared.

The exemplary club head was a fairway wood-type club head comprising a lightweight shaft-receiving structure similar to shaft-receiving structure 250. The first exemplary club head comprised a lightweight tube insert forming a hosel tube and a lightweight lower end cap forming a hosel base. The tube insert was inserted through the lower opening into the interior cavity. The end cap covered the lower opening and enclosed the tube insert within the interior cavity.

The control club head was a prior art fairway wood-type club head comprising a prior-art shaft receiving structure similar to shaft-receiving structure 150. The control club head comprised a hosel, a hosel tube, and a hosel base each formed integrally with the club head body and formed out of body material. The control club head shaft-receiving structure did not comprise any lightweight components.

Table 2 below illustrates the results of the comparative test.

TABLE 2

| Club Head | Ball Speed (mph) | Launch Angle (°) | Spin Rate (rpm) |
|---|---|---|---|
| Exemplary | 149.9 | 9.8 | 4402 |
| Control | 150.4 | 9.4 | 4393 |

As evidenced by Table 2, the exemplary club head exhibited an increase in launch angle, a slight decrease in ball speed, and a substantially similar spin rate to the control club head. The increase in launch angle is a result of the lower CG position achieved by the discretionary mass created by the inclusion of the lightweight shaft-receiving structure (as evidenced in Example 2). Although the exemplary club head exhibited a slight decrease in raw ball speed, the increased launch angle provides the ability to deloft the exemplary club head, which would return ball speed to the exemplary club head and reduce spin rate. The ability to deloft the exemplary club head provided by the increased launch angle provides an overall higher performance by resulting in a club head with similar or greater ball speed and less spin, in comparison to the control club head.

Example 4: Durability Performance of Club Head with Lightweight Shaft-Receiving Structure The exemplary club head of Example 3 was further tested for durability. Three samples of the exemplary club head were subjected to an air cannon test, wherein a golf ball was fired at the club head face at a speed of 115 mph, simulating a high-speed impact occurring during a golf swing between the club head and the ball. The first sample survived 3164 impacts, the second sample survived 3197 impacts, and the third sample survived 2413 impacts. As such, each of the three samples comprised durability on part with a prior-art golf club head. The durability of all three samples through a typical number of impacts illustrates that the structural integrity of the exemplary club head is sufficient for use in the field. The results of the durability test exhibit that the inclusion of the lightweight shaft-receiving structure provides mass property and performance benefits (outlined in Examples 1 and 2) without sacrificing the durability of the club head.

Clauses

Clause 1. A golf club head comprising: a strike face and a body secured together to define an interior cavity; the body comprising a crown, a sole opposite the crown, a heel, a toe opposite the heel, a skirt adjoining the crown and the sole, and a shaft-receiving structure; the shaft-receiving structure comprising a hosel and a shaft sleeve, the hosel formed of a first material comprising a first density; wherein: the hosel comprises a hosel wall forming at least a first portion of a hosel bore, hosel wall upper portion forming a hosel bore opening, and a hosel base opposite the hosel bore opening, the hosel base formed at an interior surface of the sole, near the heel; the hosel defines a hosel bore axis concentric with the hosel bore; the shaft sleeve is insertable into the hosel through the hosel bore opening and configured to couple a golf club shaft with the hosel; the hosel bore opening is configured to receive the shaft sleeve; a lip formed at a bottom portion of the hosel wall upper portion; the shaft-receiving structure further comprises a tube insert extending through the interior cavity, from the lip to the hosel base; the tube insert is separated from the hosel bore opening by the hosel wall upper portion; wherein the tube insert is formed of a second material comprising a second density less than the first density; the tube insert forms a remainder of the hosel bore; and the tube insert seals the hosel bore from the interior cavity.

Clause 2. The golf club head of clause 1, wherein the shaft-receiving structure further comprises a hosel length, measured parallel to the hosel bore axis from the hosel bore opening to the hosel base; the tube insert comprises a tube insert length measured from a top end of the tube insert to a bottom end; and wherein the tube insert length is between 70 and 90% of the hosel length.

Clause 3. The golf club head of clause 2, wherein the tube insert length is between 1.00 inch and 1.50 inch.

Clause 4. The golf club head of clause 1, wherein the lip is formed by a change in thickness between the hosel wall upper portion and a remainder of the hosel wall, wherein the hosel wall upper portion comprises a greater thickness than the remainder of the hosel wall.

Clause 5. The golf club head of clause 1, wherein the second material is selected from the group consisting of: a thermoset resin, a thermoplastic resin, a filled thermoplastic, a fiber-reinforced composite, a thermoplastic polyurethane (TPU) or a thermoplastic elastomer (TPE), and an aluminum alloy.

Clause 6. The golf club head of clause 1, wherein the second density is less than 3 g/cm$^3$.

Clause 7. The golf club head of clause 1, wherein a top end of the tube insert is retained by the lip, the shaft sleeve, and the hosel wall; and wherein a bottom end of the tuber insert is retained by a bottom lap joint, the hosel base, and an end cap.

Clause 8. The golf club head of clause 1, wherein the hosel wall forms a top lap joint proximate the lip and the body forms a bottom lap joint extending from the hosel base into the interior cavity; wherein the tube insert is configured to be adhesively coupled to the top lap joint and the bottom lap joint.

Clause 9. A golf club head comprising: a strike face and a body secured together to define an interior cavity; the body comprising a crown, a sole opposite the crown, a heel, a toe opposite the heel, a skirt adjoining the crown and the sole, and a shaft-receiving structure; the shaft-receiving structure comprising a hosel and a shaft sleeve, the hosel formed of a first material comprising a first density; wherein: the hosel comprises a hosel wall forming at least a first portion of a hosel bore, a hosel bore opening located at an upper end of the hosel wall, and a hosel base opposite the hosel bore opening, the hosel base formed at an interior surface of the sole, near the heel; the hosel defines a hosel bore axis concentric with the hosel bore; the shaft sleeve is insertable into the hosel through the hosel bore opening and configured to couple a golf club shaft with the hosel; the hosel bore opening is configured to receive the shaft sleeve; the hosel further hosel wall upper portion proximate the hosel bore opening; the shaft-receiving structure further comprises a tube insert extending through the interior cavity, from the hosel wall upper portion to the hosel base; the tube insert is formed of a second material comprising a second density less than the first density; the tube insert forms a remainder of the hosel bore; the tube insert seals the hosel bore from the interior cavity; wherein the shaft-receiving structure comprises a tube insert offset distance defined as a distance between the hosel bore opening and a top end of the tube insert, measured parallel to the hosel bore axis; and wherein the tube insert offset distance is greater than 0.20 inch.

Clause 10. The golf club head of clause 9, wherein the shaft-receiving structure comprises a mass of at least 3 grams less than the mass of a similar shaft-receiving structure formed entirely of the first material.

Clause 11. The golf club head of clause 9, wherein the second material is selected from the group consisting of: a thermoset resin, a thermoplastic resin, a filled thermoplastic, a fiber-reinforced composite, a thermoplastic polyurethane (TPU) or a thermoplastic elastomer (TPE), and an aluminum alloy.

Clause 12. The golf club head of clause 9, wherein the second density is less than 3 g/cm$^3$.

Clause 13. A golf club head comprising: a strike face and a body secured together to define an interior cavity; the body comprising a crown, a sole opposite the crown, a heel, a toe opposite the heel, a skirt adjoining the crown and the sole, and a shaft-receiving structure; the shaft-receiving structure comprising a hosel and a shaft sleeve, the hosel formed of a first material comprising a first density; wherein: the hosel comprises a hosel wall forming at least a first portion of a hosel bore and hosel wall upper portion forming a hosel bore opening; the shaft sleeve is insertable into the hosel through the hosel bore opening and configured to couple a golf club shaft with the hosel; the hosel bore opening is configured to receive the shaft sleeve; a lower opening located on the sole and opposite the hosel bore opening; an end cap configured to couple to the sole and close the lower opening; the shaft-receiving structure further comprises a tube insert extending through the interior cavity, from the hosel bore upper portion to the end cap; wherein the tube insert is formed of a second material comprising a second density less than the first density; wherein the end cap is formed of a third material comprising a third density less than the first density; wherein the tube insert forms a remainder of the hosel bore; and wherein the tube insert seals the hosel bore from the interior cavity.

Clause 14. The golf club head of clause 13, wherein the end cap further comprises one or more notches configured to receive a lower end of the tube insert.

Clause 15. The golf club head of clause 13, wherein the end cap further comprises an end cap body and a protrusion extending upward from the end cap body, such that the protrusion extends at least partially into the hosel bore.

Clause 16. The golf club head of clause 13, wherein the end cap further comprises an aperture extending through the end cap from an end cap bottom surface to and end cap top surface.

Clause 17. The golf club head of clause 13, wherein the tube insert is configured to be inserted into the interior cavity through the lower opening.

Clause 18. The golf club head of clause 13, wherein the second material is selected from the group consisting of: a thermoset resin, a thermoplastic resin, a filled thermoplastic, a fiber-reinforced composite, a thermoplastic polyurethane (TPU) or a thermoplastic elastomer (TPE), and an aluminum alloy.

Clause 19. The golf club head of clause 13, wherein the second density is less than 3 g/cm$^3$.

Clause 20. The golf club head of clause 13, wherein the third density is less than 3 g/cm$^3$.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to ocm$^3$ur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a strike face and a body secured together to define an interior cavity;

the body comprising a crown, a sole opposite the crown, a heel, a toe opposite the heel, a skirt adjoining the crown and the sole, and a shaft-receiving structure;

the shaft-receiving structure comprising a hosel and a shaft sleeve, the hosel formed of a first material comprising a first density;

wherein:

the hosel comprises a hosel wall forming at least a first portion of a hosel bore, a hosel wall upper portion forming a hosel bore opening, and a hosel base opposite the hosel bore opening, the hosel base formed at an interior surface of the sole, near the heel;

the hosel defines a hosel bore axis concentric with the hosel bore;

the shaft sleeve is insertable into the hosel through the hosel bore opening and configured to couple a golf club shaft with the hosel;

the hosel bore opening is configured to receive the shaft sleeve;

a lip formed at a bottom portion of the hosel wall upper portion;

the shaft-receiving structure further comprises a tube insert extending through the interior cavity, from the lip to the hosel base;

the tube insert is separated from the hosel bore opening by the hosel wall upper portion;

wherein a top end of the tube insert is retained by the lip, the shaft sleeve, and the hosel wall; and wherein a bottom end of the tube insert is retained by a bottom lap joint, the hosel base, and an end cap;

wherein the tube insert is formed of a second material comprising a second density less than the first density;

the tube insert forms a remainder of the hosel bore; and the tube insert seals the hosel bore from the interior cavity.

2. The golf club head of claim 1, wherein the shaft-receiving structure further comprises a hosel length, measured parallel to the hosel bore axis from the hosel bore opening to the hosel base;

the tube insert comprises a tube insert length measured from a top end of the tube insert to a bottom end; and wherein the tube insert length is between 70 and 90% of the hosel length.

3. The golf club head of claim 2, wherein the tube insert length is between 1.00 inch and 1.50 inch.

4. The golf club head of claim 1, wherein the lip is formed by a change in thickness between the hosel wall upper portion and a remainder of the hosel wall, wherein the hosel wall upper portion comprises a greater thickness than the remainder of the hosel wall.

5. The golf club head of claim 1, wherein the second material is selected from the group consisting of: a thermoset resin, a thermoplastic resin, a filled thermoplastic, a fiber-reinforced composite, a thermoplastic polyurethane (TPU) or a thermoplastic elastomer (TPE), and an aluminum alloy.

6. The golf club head of claim 1, wherein the second density is less than 3 $g/cm^3$.

* * * * *